US008674914B2

(12) United States Patent
Ohhashi

(10) Patent No.: US 8,674,914 B2
(45) Date of Patent: Mar. 18, 2014

(54) DISPLAY DEVICE AND METHOD OF DRIVING THE SAME

(75) Inventor: Seiji Ohhashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 576 days.

(21) Appl. No.: 12/737,294

(22) PCT Filed: Jun. 1, 2009

(86) PCT No.: PCT/JP2009/059946
§ 371 (c)(1),
(2), (4) Date: Dec. 28, 2010

(87) PCT Pub. No.: WO2010/016316
PCT Pub. Date: Feb. 11, 2010

(65) Prior Publication Data

US 2011/0096059 A1 Apr. 28, 2011

(30) Foreign Application Priority Data

Aug. 7, 2008 (JP) ..... 2008-203765

(51) Int. Cl.
*G09G 3/32* (2006.01)

(52) U.S. Cl.
USPC ..... 345/83

(58) Field of Classification Search
USPC ..... 345/76–83
See application file for complete search history.

(56) References Cited

U.S. PATENT DOCUMENTS

| | | | |
|---|---|---|---|
| 6,229,506 | B1 | 5/2001 | Dawson et al. |
| 6,734,875 | B1 | 5/2004 | Tokimoto et al. |
| 7,259,737 | B2 | 8/2007 | Ono et al. |
| 7,511,708 | B2 | 3/2009 | Numao |

(Continued)

FOREIGN PATENT DOCUMENTS

| | | | |
|---|---|---|---|
| JP | 2002-514320 | T | 5/2002 |
| JP | 2004-341359 | A | 12/2004 |

(Continued)

OTHER PUBLICATIONS

Kazutaka Inukai et al. "4.0-in. TFT-OLED Displays and a Novel Digital Driving Method", SID'00 Digest, pp. 924-927, Semiconductor Energy Laboratory Co., Ltd.

(Continued)

*Primary Examiner* — Bipin Shalwala
*Assistant Examiner* — Steven Holton
(74) *Attorney, Agent, or Firm* — Harness, Dickey & Pierce, P.L.C.

(57) ABSTRACT

Switching TFTs are controlled to a conducting state and a switching TFT to a non-conducting state, to provide a potential according to a threshold voltage to a gate terminal of a driving TFT. Then, in at least one embodiment, with the TFT maintaining the conducting state, a potential of a data line Sj is changed from a reference potential Vpc to a data potential Vdata to place the TFT in a conducting state. At this time, a current Ia flows and thus the gate terminal potential of the TFT rises. The higher the mobility of the TFT, the larger the amount of change in gate terminal potential and the smaller the current flowing through an organic EL element upon light emission. By this, a current that is not affected by variations in the threshold voltage of the TFT nor by variations in the mobility of the TFT flows through the organic EL element. Thus, in a current-driven type display device, variations in both the threshold voltage and mobility of a drive element are compensated for.

6 Claims, 9 Drawing Sheets

(56) References Cited

U.S. PATENT DOCUMENTS

| | | | |
|---|---|---|---|
| 7,755,585 | B2 | 7/2010 | Kim |
| 7,808,008 | B2 | 10/2010 | Miyake |
| 7,825,880 | B2 | 11/2010 | Yumoto et al. |
| 2004/0252089 | A1 | 12/2004 | Ono et al. |
| 2006/0028409 | A1 | 2/2006 | Numao |
| 2006/0170628 | A1 | 8/2006 | Yamashita et al. |
| 2007/0063935 | A1 | 3/2007 | Yoshida |
| 2007/0103406 | A1 | 5/2007 | Kim |
| 2007/0247399 | A1 | 10/2007 | Yamashita et al. |
| 2008/0048955 | A1 | 2/2008 | Yumoto et al. |
| 2008/0169765 | A1 | 7/2008 | Yamazaki et al. |
| 2008/0218497 | A1 | 9/2008 | Takahashi |
| 2009/0001378 | A1 | 1/2009 | Miyake |
| 2011/0037788 | A1 | 2/2011 | Ohhashi |

FOREIGN PATENT DOCUMENTS

| | | | |
|---|---|---|---|
| JP | 2006-047787 | A | 2/2006 |
| JP | 2006-215213 | A | 8/2006 |
| JP | 2007-133369 | A | 5/2007 |
| JP | 2008-051960 | A | 3/2008 |
| JP | 2008-131568 | A | 6/2008 |
| JP | 2008-216941 | A | 9/2008 |
| JP | 2009-031782 | A | 2/2009 |
| JP | 2009-115839 | A | 5/2009 |
| JP | 2009-115840 | A | 5/2009 |
| KR | 10-2008-0051175 | | 6/2008 |
| RU | 2 113 066 | | 12/1988 |
| RU | 2 249 858 | | 8/2003 |
| WO | WO 89/06417 | | 7/1989 |
| WO | WO-9848403 | A1 | 10/1998 |

OTHER PUBLICATIONS

Toru Takayama et al. "Continuous Grain Silicon Technology and Its Applications for Active Matrix Display", AM-LCD 2000, pp. 25-28, Semiconductor Energy Laboratory Co., Ltd.

R.H. Friend "Polymer Light-Emitting Diodes for Use in Flat Panel Display", AM-LCD '01, pp. 211-214, University of Cambridge, Cambridge Display Technology.

DISPLAY DEVICE AND METHOD OF DRIVING THE SAME

TECHNICAL FIELD

The present invention relates to a display device, and more particularly, to a current-driven type display device such as an organic EL display or an FED, and a method of driving the display device.

BACKGROUND ART

In recent years, there has been an increasing demand for thin, lightweight, and fast response display devices. Correspondingly, research and development for organic EL (Electro Luminescence) displays and FEDs (Field Emission Displays) have been actively conducted.

Organic EL elements included in an organic EL display emit light at higher luminance with a higher voltage applied thereto and a larger amount of current flowing therethrough. However, the relationship between the luminance and voltage of the organic EL elements easily fluctuates by the influence of drive time, ambient temperature, etc. Due to this, when a voltage control type drive scheme is applied to the organic EL display, it is very difficult to suppress, variations in the luminance of the organic EL elements. In contrast to this, the luminance of the organic EL elements is substantially proportional to current, and this proportional relationship is less susceptible to external factors such as ambient temperature. Therefore, it is desirable to apply a current control type drive scheme to the organic EL display.

Meanwhile, pixel circuits and drive circuits of a display device are formed using TFTs (Thin Film Transistors) composed of amorphous silicon, low-temperature polycrystal silicon, CG (Continuous Grain) silicon, etc. However, variations are likely to occur in TFT characteristics (e.g., threshold voltage and mobility). Hence, a circuit that compensates for variations in TFT characteristics is provided in a pixel circuit of an organic EL display. By the action of this circuit, variations in the luminance of an organic EL element are suppressed.

Schemes to compensate for variations in TFT characteristics in the current control type drive scheme are broadly classified into a current program scheme that controls the amount of current flowing through a driving TFT by a current signal; and a voltage program scheme that controls such an amount of current by a voltage signal. By using the current program scheme variations in threshold voltage and mobility can be compensated for, and by using the voltage program scheme only variations in threshold voltage can be compensated for.

The current program scheme, however, has the following problems. First, since a very small amount of current is handled, it is difficult to design pixel circuits and drive circuits. Second, since the influence of parasitic capacitance is likely to be received while a current signal is set, it is difficult to achieve an increase in area. On the other hand, in the voltage program scheme, the influence of parasitic capacitance, etc., is very small and a circuit design is relatively easy. In addition, the influence of variations in mobility exerted on the amount of current is smaller than the influence of variations in threshold voltage exerted on the amount of current, and the variations in mobility can be suppressed to a certain extent in a TFT fabrication process. Therefore, even with a display device to which the voltage program scheme is applied, sufficient display quality can be obtained.

For an organic EL display to which the current control type drive scheme is applied, various configurations have been conventionally known. For example, Patent Document 1 describes that a pixel circuit 100 shown in FIG. 2 (details will be described later) is driven according to a timing chart shown in FIG. 13. In a drive method shown in FIG. 13, before time t1, the potentials of a scanning line Gi and a control wiring line Wi are controlled to a high level, the potential of a control wiring line Ri to a low level, and the potential of a data line Sj to a reference potential Vpc. When at time t1 the potential of the scanning line Gi is changed to a low level, a switching TFT 111 changes to a conducting state. Then, when at time t2 the potential of the control wiring line Wi is changed to a low level, a switching TFT 112 changes to a conducting state. By this, the gate and drain terminals of a driving TFT 110 are short-circuited and reach the same potential.

Then, when at time t3 the potential of the control wiring line Ri is changed to a high level, a switching TFT 113 changes to a non-conducting state. At this time, a current flows into the gate terminal of the driving TFT 110 from a power supply wiring line Vp through the driving TFT 110 and the switching TFT 112, and thus the gate terminal potential of the driving TFT 110 rises while the driving TFT 110 is in a conducting state. Since the driving TFT 110 changes to a non-conducting state when the gate-source voltage thereof reaches a threshold voltage Vth (negative value), the gate terminal potential of the driving TFT 110 rises to (VDD+Vth).

Then, when at time t4 the potential of the control wiring line Wi is changed to a high level, the switching TFT 112 changes to a non-conducting state. At this time, a potential difference (VDD+Vth−Vpc) between the gate terminal of the driving TFT 110 and the data line Sj is held in a capacitor 121.

Then, when at time t5 the potential of the data line Sj is changed from the reference potential Vpc to a data potential Vdata, the gate terminal potential of the driving TFT 110 changes by the same amount (Vdata−Vpc) and reaches (VDD+Vth+Vdata−Vpc). Then, when at time t6 the potential of the scanning line Gi is changed to a high level, the switching TFT 111 changes to a non-conducting state. At this time, a gate-source voltage (Vth+Vdata−Vpc) of the driving TFT 110 is held in a capacitor 122.

Then, at time t7, the potential of the data line Sj changes from the data potential Vdata to the reference potential Vpc. Then, when at time t8 the potential of the control wiring line Ri is changed to a low level, the switching TFT 113 changes to a conducting state. By this, a current flows to an organic EL element 130 from the power supply wiring line Vp through the driving TFT 110 and the switching TFT 113. The amount of current flowing through the driving TFT 110 increases and decreases according to the gate terminal potential thereof (VDD+Vth+Vdata−Vpc). Even if the threshold voltage Vth is different, if the potential difference (Vdata−Vpc) is the same, then the amount of current is the same. Therefore, regardless of the value of the threshold voltage Vth, a current of an amount according to the data potential Vdata flows through the organic EL element 130, and thus the organic EL element 130 emits light at a luminance according to the data potential Vdata.

Accordingly, by driving the pixel circuit 100 shown in FIG. 2 according to the timing chart shown in FIG. 13, regardless of the threshold voltage Vth of the driving TFT 110, a current of a desired amount is allowed to flow through the organic EL element 130, and thus the organic EL element 130 is allowed to emit light at a desired luminance.

Patent Document 2 describes that a pixel circuit 900 shown in FIG. 14 is driven according to a timing chart shown in FIG.

15 (note that, for easy contrast with the present invention, the names of signal lines are changed). In a drive method shown in FIG. 15, before time t1, the potentials of scanning lines G1*l* and G2*i* are controlled to a high level, and the potential of a control wiring line Ei to a low level. When at time t1 the potential of the control wiring line Ei is changed to a high level, switching TFTs 913 and 914 change to a non-conducting state. Then, when at time t2 the potentials of the scanning lines G1*l* and G2*i* are changed to a low level, switching TFTs 911, 912, and 915 change to a conducting state. By this, the gate and drain terminals of a driving TFT 910 are short-circuited and reach the same potential, and a gate terminal potential Vg of the driving TFT 910 becomes equal to a potential Vpc of a power supply wiring line Vint. In addition, a potential Vdata of a data line Sj is applied to a connection point between the switching TFT 911 and a capacitor 921 (hereinafter, referred to as a connection point B).

Then, when at time t3 the potential of the scanning line G2*i* is changed to a high level, the switching TFT 915 changes to a non-conducting state. At this time, a current flows into the gate terminal of the driving TFT 910 from a power supply wiring line Vp through the driving TFT 910 and the switching TFT 912, and thus the gate terminal potential Vg of the driving TFT 910 rises while the driving TFT 910 is in a conducting state. Since the driving TFT 910 changes to a non-conducting state when the gate-source voltage thereof reaches a threshold voltage Vth (negative value), the gate terminal potential Vg of the driving TFT 910 rises to (VDD+Vth).

Then, when at time t4 the potential of the scanning line G1*i* is changed to a high level and the potential of the control wiring line Ei is changed to a low level, the switching TFTs 911 and 912 change to a non-conducting state, and the switching TFTs 913 and 914 change to a conducting state. At this time, the potential at the connection point B changes from Vdata to Vpc, and the gate terminal potential Vg of the driving TFT 910 changes by the same amount as the potential at the connection point B and reaches (VDD+Vth+Vpc−Vdata). The capacitor 921 holds a potential difference (VDD+Vth−Vdata) between the gate terminal of the driving TFT 910 and the power supply wiring line Vint.

After time t4, a current flows to an organic EL element 930 from the power supply wiring line Vp through the driving TFT 910 and the switching TFT 913. The amount of current flowing through the driving TFT 910 increases and decreases according to the gate terminal potential thereof (VDD+Vth+Vpc−Vdata). Even if the threshold voltage Vth is different, if the potential difference (Vpc−Vdata) is the same, then the amount of current is the same. Therefore, regardless of the value of the threshold voltage Vth, a current of an amount according to the data potential Vdata flows through the organic EL element 930, and thus the organic EL element 930 emits light at a luminance according to the data potential Vdata.

Accordingly, by driving the pixel circuit 900 shown in FIG. 14 according to the timing chart shown in FIG. 15, regardless of the threshold voltage Vth of the driving TFT 910, a current of a desired amount is allowed to flow through the organic EL element 930, and thus the organic EL element 930 is allowed to emit light at a desired luminance.

Note that examples of the organic EL display to which the current control type drive scheme is applied are also described in Patent Document 3 and another application (Japanese Patent Application No. 2008-131568, filed on May 20, 2008) having a common applicant and a common inventor with the present application.

RELATED DOCUMENTS

Patent Documents

[Patent Document 1] International Publication Pamphlet No. WO 98/48403

[Patent Document 2] Japanese Laid-Open Patent Publication No. 2007-133369

[Patent Document 3] Japanese Laid-Open Patent Publication No. 2004-341359

Non-Patent Documents

[Non-Patent Document 1] "4.0-in. TFT-OLED Displays and a Novel Digital Driving Method", SID'00 Digest, pp. 924-927, Semiconductor Energy Laboratory Co., Ltd.

[Non-Patent Document 2] "Continuous Grain Silicon Technology and Its Applications for Active Matrix Display", AM-LCD 2000, pp. 25-28, Semiconductor Energy Laboratory Co., Ltd.

[Non-Patent Document 3] "Polymer Light-Emitting Diodes for Use in Flat Panel Display", AM-LCD' 01, pp. 211-214, University of Cambridge, Cambridge Display Technology

DISCLOSURE OF THE INVENTION

Problems to be Solved by the Invention

In the pixel circuit 100 shown in FIG. 2, when the driving TFT 110 is allowed to operate in a saturation region, a current Ids flowing between the drain and source of the driving TFT 110 is expressed as shown in the following equation (1), using a gate-source voltage Vgs of the driving TFT 110:

$$Ids=(1/2)\cdot(W/L)\cdot\mu\cdot Cox(Vgs-Vth)^2 \quad (1).$$

Note that in equation (1), W indicates a channel width of the driving TFT 110, L indicates a channel length of the driving TFT 110, μ indicates a mobility of the driving TFT 110, Cox indicates a gate oxide film capacitance of the driving TFT 110, and Vth indicates a threshold voltage of the driving TFT 110.

Of the values included in equation (1), variations are likely to occur in the threshold voltage Vth and the mobility μ during a TFT fabrication process. Hence, when the pixel circuit 100 shown in FIG. 2 is driven according to the timing chart shown in FIG. 13, since the amount of current flowing through the organic EL element 130 fluctuates by the influence of variations in the mobility of the driving TFT 110, it is difficult to allow the organic EL element 130 to emit light at a desired luminance. The same problem also occurs when the pixel circuit 900 shown in FIG. 14 is driven according to the timing chart shown in FIG. 15.

An object of the present invention is therefore to provide a display device that compensates for both variations in the threshold voltage of a drive element and variations in the mobility of the drive element using a voltage program scheme, and a method of driving the display device.

Means for Solving the Problems

According to a first aspect of the present invention, there is provided a current-driven type display device including: a plurality of pixel circuits arranged at respective intersections of a plurality of scanning lines and a plurality of data lines; and a drive circuit that selects a write-target pixel circuit using the corresponding scanning line, and provides a data potential according to display data to the corresponding data line, wherein each of the pixel circuits includes: an electro-optic element provided between a first power supply wiring line and a second power supply wiring line; a drive element provided in series with the electro-optic element and between the first power supply wiring line and the second power supply wiring line; a compensation capacitor having a first electrode connected to a control terminal of the drive element; and a compensation switching element provided between the control terminal and one current input/output terminal of the drive element, and for the write-target pixel circuit, the drive circuit controls the compensation switching element to a conducting state to provide a potential according to a threshold voltage to the control terminal of the drive element, and thereafter switches a potential provided to a second electrode of the compensation capacitor to another with the compensation switching element maintaining the conducting state, to provide a write potential according to the display data and the threshold voltage to the control terminal of the drive element.

According to a second aspect of the present invention, in the first aspect of the present invention, each of the pixel circuits further includes: a writing switching element provided between the second electrode of the compensation capacitor and the corresponding data line; an interruption switching element provided between the drive element and the electro-optic element; and a holding capacitor provided between the control terminal and the other current input/output terminal of the drive element.

According to a third aspect of the present invention, in the second aspect of the present invention, for the write-target pixel circuit, the drive circuit controls the writing switching element and the compensation switching element to a conducting state and controls the interruption switching element to a non-conducting state while providing a predetermined reference potential to the data line, and thereafter switches a potential provided to the data line to the data potential with states of the respective switching elements being maintained.

According to a fourth aspect of the present invention, in the first aspect of the present invention, each of the pixel circuits further includes: an interruption, switching element provided between the one current input/output terminal of the drive element and the first power supply wiring line; and a writing switching element provided between the other current input/output terminal of the drive element and the corresponding data line, wherein the second electrode of the compensation capacitor is connected to a control wiring line to which the drive circuit provides a potential.

According to a fifth aspect of the present invention, in the fourth aspect of the present invention, for the write-target pixel circuit, the drive circuit controls the writing switching element and the compensation switching element to a conducting state and controls the interruption switching element to a non-conducting state while providing the data potential to the data line; and thereafter switches the potential provided to the control wiring line to another with states of the respective switching elements being maintained, to provide the write potential to the control terminal of the drive element.

According to a sixth aspect of the present invention, in the fifth aspect of the present invention, after the drive circuit switches the potential provided to the control wiring line to another to provide the write potential to the control terminal of the drive element, the drive circuit switches the potential provided to the data line to a reference potential which is closer to the potential at the control terminal of the drive element than the data potential.

According to a seventh aspect of the present invention, in the fifth aspect of the present invention, for the write-target pixel circuit, the drive circuit provides, to the data line, a potential determined by the display data and an amount of change in potential provided to the control wiring line, while the writing switching element is controlled to the conducting state.

According to an eighth aspect of the present invention, in the fifth aspect of the present invention, for the write-target pixel circuit, the drive circuit provides, to the data line, a potential at which a voltage applied to the electro-optic element is lower than or equal to a light-emission threshold voltage, while the writing switching element is controlled to the conducting state.

According to a ninth aspect of the present invention, in the first aspect of the present invention, each of the pixel circuits further includes: a writing switching element provided between the second electrode of the compensation capacitor and the corresponding data line; an interruption switching element provided between the drive element and the electro-optic element; a first initialization switching element provided between the second electrode of the compensation capacitor and a third power supply wiring line; and a second initialization switching element provided between the one current input/output terminal of the drive element and the third power supply wiring line.

According to a tenth aspect of the present invention, in the ninth aspect of the present invention, for the write-target pixel circuit, the drive circuit controls the writing switching element, the compensation switching element, and the second initialization switching element to a conducting state and controls the interruption switching element and the first initialization switching element to a non-conducting state while providing the data potential to the data line, and thereafter controls the writing switching element to a non-conducting state and controls the first initialization switching element to a conducting state with the compensation switching element maintaining the conducting state.

According to an eleventh aspect of the present invention, there is provided a method of driving a current-driven type display device including a plurality of pixel circuits arranged at respective intersections of a plurality of scanning lines and a plurality of data lines, the method including: when each of the pixel circuits includes an electro-optic element provided between a first power supply wiring line and a second power supply wiring line; a drive element provided in series with the electro-optic element and between the first power supply wiring line and the second power supply wiring line; a compensation capacitor having a first electrode connected to a control terminal of the drive element; and a compensation switching element provided between the control terminal and one current input/output terminal of the drive element, a selecting step of selecting a write-target pixel circuit using the corresponding scanning line; a threshold state setting step of controlling, for the write-target pixel circuit, the compensation switching element to a conducting state to provide a potential according to a threshold voltage to the control terminal of the drive element; and a conducting state setting step of switching, for the write-target pixel circuit, after the threshold state setting step, a potential provided to a second electrode of the compensation capacitor to another with the compensation switching element maintaining the conducting state, to provide a write potential according to display data and the threshold voltage to the control terminal of the drive element.

According to a twelfth aspect of the present invention, in the eleventh aspect of the present invention, when each of the pixel circuits further includes: a writing switching element provided between the second electrode of the compensation capacitor and the corresponding data line; an interruption switching element provided between the drive element and the electro-optic element; and a holding capacitor provided between the control terminal and the other current input/output terminal of the drive element, in the threshold state setting step, for the write-target pixel circuit, the writing switching element and the compensation switching element are controlled to a conducting state and the interruption switching element is controlled to a non-conducting state while a predetermined reference potential is provided to the corresponding data line, and in the conducting state setting step, the potential provided to the data line is switched to a data potential according to the display data, with states of the respective switching elements being maintained.

According to a thirteenth aspect of the present invention, in the eleventh aspect of the present invention, when each of the pixel circuits further includes: an interruption switching element provided between the one current input/output terminal of the drive element and the first power supply wiring line; and a writing switching element provided between the other current input/output terminal of the drive element and the corresponding data line, and the second electrode of the compensation capacitor is connected to a control wiring line, in the threshold state setting step, for the write-target pixel circuit, the writing switching element and the compensation switching element are controlled to a conducting state and the interruption switching element is controlled to a non-conducting state while a data potential according to the display data is provided to the corresponding data line, and in the conducting state setting step, a potential provided to the control wiring line is switched to another with states of the respective switching elements being maintained, to provide the write potential to the control terminal of the drive element.

According to a fourteenth aspect of the present invention, in the eleventh aspect of the present invention, when each of the pixel circuits further includes: a writing switching element provided between the second electrode of the compensation capacitor and the corresponding data line; an interruption switching element provided between the drive element and the electro-optic element; a first initialization switching element provided between the second electrode of the compensation capacitor and a third power supply wiring line; and a second initialization switching element provided between the one current input/output terminal of the drive element and the third power supply wiring line, in the threshold state setting step, for the write-target pixel circuit, the writing switching element, the compensation switching element, and the second initialization switching element are controlled to a conducting state and the interruption switching element and the first initialization switching element are controlled to a non-conducting state while a data potential according to the display data is provided to the corresponding data line, and in the conducting state setting step, the writing switching element is controlled to a non-conducting state and the first initialization switching element is controlled to a conducting state, with the compensation switching element maintaining the conducting state.

Effect of the Invention

According to the first or eleventh aspect of the present invention, by controlling the compensation switching element to a conducting state, the drive element is placed in a state in which the threshold voltage is applied to the control terminal thereof. Thereafter, by switching the potential provided to the second electrode of the compensation capacitor to another with the compensation switching element maintaining the conducting state, a write potential according to display data and the threshold voltage is provided to the control terminal of the drive element. Except for the case of black display, the drive element is placed in a conducting state and thus a current according to the mobility of the drive element flows through the compensation switching element and the drive element, and the potential at the control terminal of the drive element changes according to the mobility of the drive element. By this, upon light emission of the electro-optic element, a current that is not affected by variations in the threshold voltage of the drive element nor by variations in the mobility of the drive element is allowed to flow through the electro-optic element. Accordingly, both variations in the threshold voltage of the drive element and variations in the mobility of the drive element can be compensated for, and thus the electro-optic element is allowed to emit light at a desired luminance.

According to the second aspect of the present invention, in a display device including pixel circuits, each including an electro-optic element, a drive element, three switching elements (for compensation, writing, and interruption), and two capacitors (for compensation and holding), a current that is not affected by variations in the threshold voltage of the drive element nor by variations in the mobility of the drive element is allowed to flow through the electro-optic element, whereby both variations in the threshold voltage of the drive element and variations in the mobility of the drive element can be compensated for.

According to the third or twelfth aspect of the present invention, by controlling the writing switching element and the compensation switching element to a conducting state and controlling the interruption switching element to a non-conducting state while providing a reference potential to the data line, a potential where variations in the threshold voltage of the drive element are corrected can be provided to the control terminal of the drive element. Then, by switching the potential provided to the second electrode of the compensation capacitor to another with the states of the respective switching elements being maintained, a write potential according to display data and the threshold voltage can be provided to the control terminal of the drive element. Thereafter, the potential at the control terminal of the drive element changes according to the mobility of the drive element. By this, a current that is not affected by variations in the threshold voltage of the drive element nor by variations in the mobility of the drive element is allowed to flow through the electro-optic element, whereby both variations in the threshold voltage of the drive element and variations in the mobility of the drive element can be compensated for.

According to the fourth aspect of the present invention, in a display device including pixel circuits, each including an electro-optic element, a drive element, three switching elements (for compensation, writing, and interruption), and a compensation capacitor, a current that is not affected by variations in the threshold voltage of the drive element nor by variations in the mobility of the drive element is allowed to flow through the electro-optic element, whereby both variations in the threshold voltage of the drive element and variations in the mobility of the drive element can be compensated for.

According to the fifth or thirteenth aspect of the present invention, by controlling the writing switching element and the compensation switching element to a conducting state and controlling the interruption switching element to a non-conducting state while providing a data potential to the data line, a potential where variations in the threshold voltage of the drive element are corrected can be provided to the control terminal of the drive element. Then, by switching the potential provided to the control wiring line connected to the second electrode of the compensation capacitor to a suitable level with the states of the respective switching elements being maintained, a write potential according to display data and the threshold voltage can be provided to the control terminal of the drive element. Thereafter, the potential at the control terminal of the drive element changes according to the mobility of the drive element. By this, a current that is not affected by variations in the threshold voltage of the drive element nor by variations in the mobility of the drive element is allowed to flow through the electro-optic element, whereby both variations in the threshold voltage of the drive element and variations in the mobility of the drive element can be compensated for.

According to the sixth aspect of the present invention, by providing, to the data line, a reference potential that is closer to the potential at the control terminal of the drive element than the data potential, the change in potential at the control terminal of the drive element can be reduced. Accordingly, even if the mobility of the drive element is high, the influence of the mobility of the drive element exerted on the potential at the control terminal of the drive element can be reduced, and thus both variations in the threshold voltage of the drive element and variations in the mobility of the drive element can be compensated for.

According to the seventh aspect of the present invention, when the data potential is provided to the data line, by providing a potential according to the amount of change in the potential of the control wiring line, the electro-optic element is allowed to emit light at a luminance according to display data.

According to the eighth aspect of the present invention, when the data potential is provided to the data line, by providing a potential at which the voltage applied to the electro-optic element is lower than or equal to the light-emission threshold voltage, only writing the potential of the data line to the pixel circuit does not allow the electro-optic element to emit light. This allows only a write-target pixel circuit to be controlled to a non-light emitting state with other pixel circuits being allowed to emit light, enabling to increase the light-emission duty ratio.

According to the ninth aspect of the present invention, in a display device including pixel circuits, each including an electro-optic element, a drive element, five switching elements (for compensation, writing, interruption, and two for initialization), and a compensation capacitor, a current that is not affected by variations in the threshold voltage of the drive element nor by variations in the mobility of the drive element is allowed to flow through the electro-optic element, whereby both variations in the threshold voltage of the drive element and variations in the mobility of the drive element can be compensated for.

According to the tenth or fourteenth aspect of the present invention, by controlling the writing switching element, the compensation switching element, and the second initialization switching element to a conducting state and controlling the interruption switching element and the first initialization switching element to a non-conducting state while providing a data potential to the data line, a potential where variations in the threshold voltage of the drive element are corrected can be provided to the control terminal of the drive element. Then, by controlling the writing switching element to a non-conducting state and controlling the first initialization switching element to a conducting state with the compensation switching element maintaining the conducting state, the potential provided to the second electrode of the compensation capacitor is switched to another, whereby a write potential according to display data and the threshold voltage can be provided to the control terminal of the drive element. Thereafter, the potential at the control terminal of the drive element changes according to the mobility of the drive element. By this, a current that is not affected by variations in the threshold voltage of the drive element nor by variations in the mobility of the drive element is allowed to flow through the electro-optic element, whereby both variations in the threshold voltage of the drive element and variations in the mobility of the drive element can be compensated for.

MODE FOR CARRYING OUT THE INVENTION

Display devices according to first to fourth embodiments of the present invention will be described below with reference to FIGS. 1 to 12. The display devices according to the embodiments include pixel circuits, each including an electro-optic element, a drive element, a capacitor (s), and a plurality of switching elements. The switching elements can be composed of low-temperature polysilicon TFTs, CG silicon TFTs, amorphous silicon TFTs, etc. The configurations and fabrication processes of these TFTs are known and thus description thereof is omitted here. For the electro-optic element, an organic EL element is used. The configuration of the organic EL element is also known and thus description thereof is omitted here.

Figure 1:
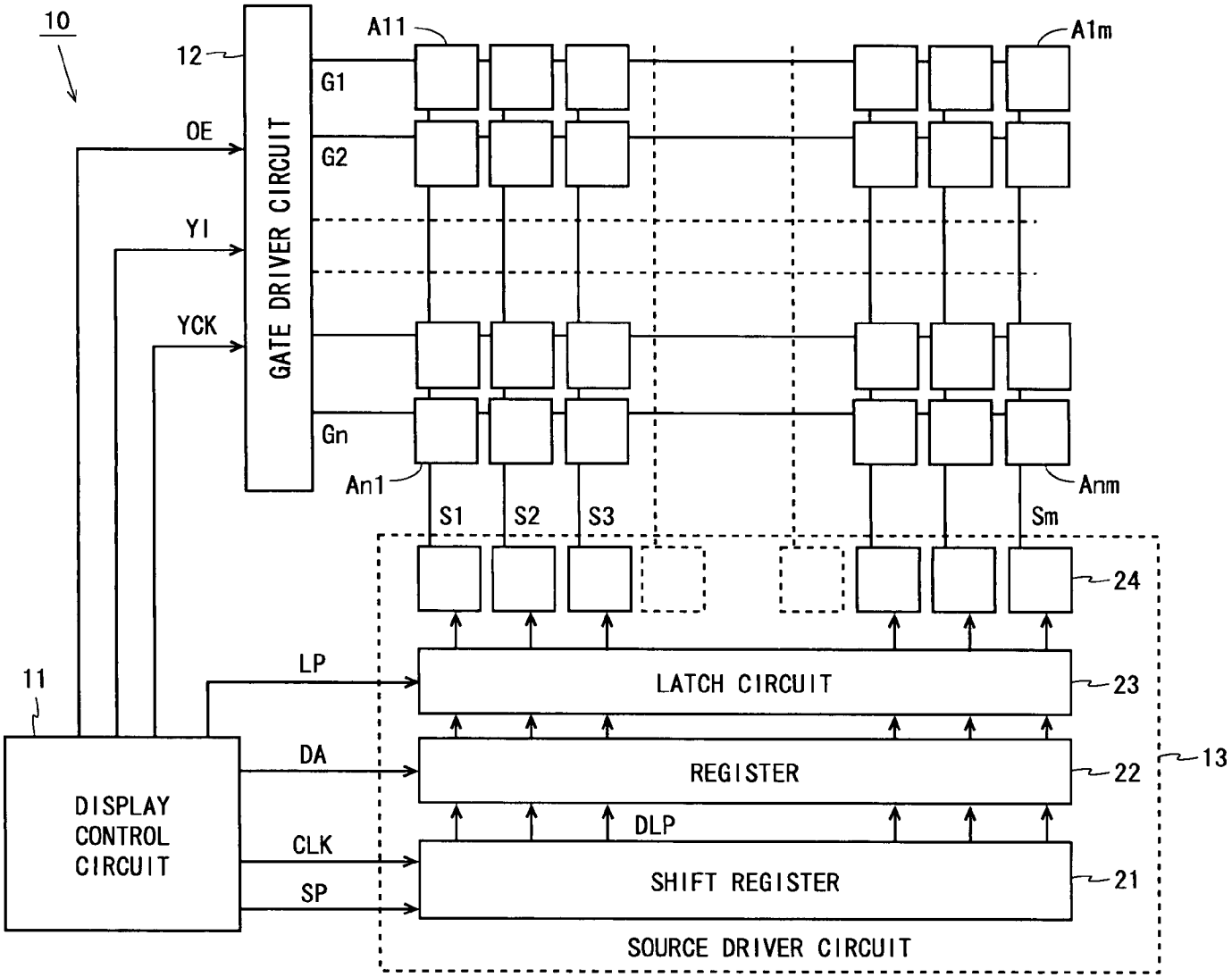
FIG. 1 is a block diagram showing a configuration of display devices according to first to fourth embodiments of the present invention.

FIG. 1 is a block diagram showing a configuration of the display devices according to the first to fourth embodiments of the present invention. A display device 10 shown in FIG. 1 includes a plurality of pixel circuits Aij (i is an integer between 1 and n inclusive and j is an integer between 1 and m inclusive), a display control circuit 11, a gate driver circuit 12, and a source driver circuit 13. In the display device 10, there are provided a plurality of scanning lines Gi arranged parallel to one another and a plurality of data lines Sj arranged parallel to one another so as to intersect perpendicularly with the scanning lines Gi. The pixel circuits Aij are arranged in a matrix form at respective intersections of the scanning lines Gi and the data lines Sj.

In addition to them, in the display device 10, a plurality of control wiring lines (Ri, Ui, Wi, etc.; not shown) are arranged parallel to the scanning lines Gi. In addition, though not shown in FIG. 1, in a region where the pixel circuits Aij are arranged, a power supply wiring line Vp and a common cathode Vcom are arranged. The scanning lines Gi and the control wiring lines are connected to the gate driver circuit 12 and are driven by the gate driver circuit 12. The data lines Sj are connected to the source driver circuit 13 and are driven by the source driver circuit 13.

The display control circuit 11 outputs a timing signal OE, a start pulse YI, and a clock YCK to the gate driver circuit 12, and outputs a start pulse SP, a clock CLK, display data DA, and a latch pulse LP to the source driver circuit 13.

The gate driver circuit 12 and the source driver circuit 13 are drive circuits for the pixel circuits Aij. The gate driver circuit 12 functions as a scanning signal output circuit that selects write-target pixel circuits, using a corresponding scanning line Gi. The source driver circuit 13 functions as a display signal output circuit that provides potentials according to display data (hereinafter, referred to as data potentials) to the corresponding data lines Sj.

More specifically, the gate driver circuit 12 includes a shift register circuit, a logic operation circuit, and buffers (none of which are shown). The shift register circuit sequentially transfers the start pulse YI in synchronization with the clock YCK. The logic operation circuit performs a logic operation between a pulse outputted from each stage of the shift register circuit and the timing signal OE. An output from the logic operation circuit is provided to a corresponding scanning line Gi and corresponding control wiring lines through the buffer.

The source driver circuit 13 includes an m-bit shift register 21, a register 22, a latch circuit 23, and m D/A converters 24. The shift register 21 includes m cascade-connected one-bit registers. The shift register 21 sequentially transfers the start pulse SP in synchronization with the clock CLK, and outputs timing pulses DLP from the registers of the respective stages. The display data DA is supplied to the register 22 in accordance with output timing of the timing pulses DLP. The register 22 stores the display data DA according to the timing pulses DLP. When the display data DA corresponding to one row is stored in the register 22, the display control circuit 11 outputs the latch pulse LP to the latch circuit 23. When the latch circuit 23 receives the latch pulse LP, the latch circuit 23 holds the display data stored in the register 22. One D/A converter 24 is provided to one data line Sj. The D/A converters 24 convert the display data held in the latch circuit 23 into analog signal voltages, and provide the analog signal voltages to the corresponding data lines Sj.

Note that although here the source driver circuit 13 performs line sequential scanning where data potentials for one row are simultaneously supplied to pixel circuits connected to one scanning line, dot sequential scanning may be performed instead where a data potential is supplied in turn to each pixel circuit. The configuration of a source driver circuit that performs dot sequential scanning is known and thus description thereof is omitted here.

The pixel circuits Aij included in the display devices according to the embodiments will be described in detail below. A driving TFT, switching TFTs, and an organic EL element included in each pixel circuit Aij function as a drive element, switching elements, and an electro-optic element, respectively. The power supply wiring line Vp corresponds to a first power supply wiring line, the common cathode Vcom corresponds to a second power supply wiring line, and a power supply wiring line Vint corresponds to a third power supply wiring line.

(First Embodiment)

Figure 2:
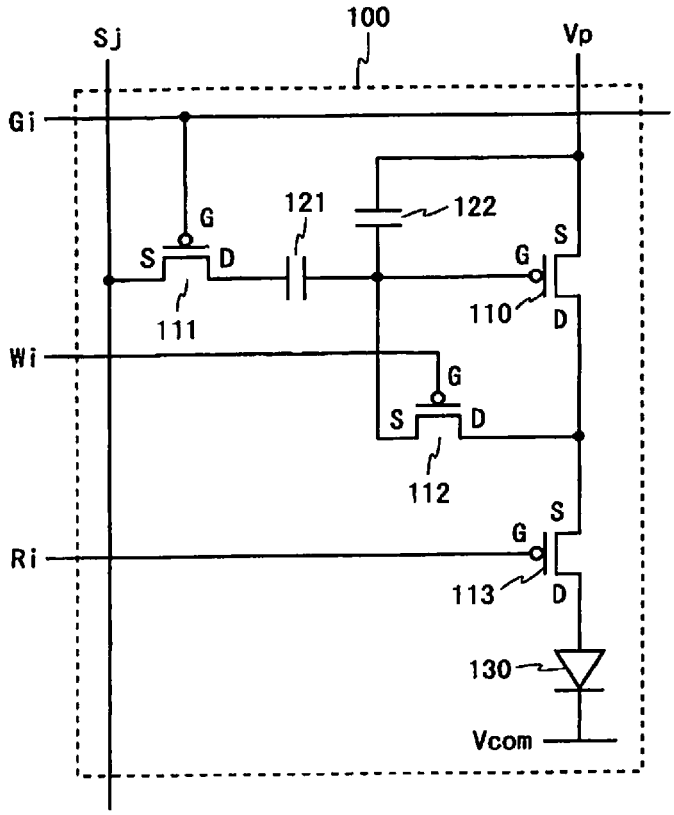
Fig. 2 Conventional Art
FIG. 2 is a circuit diagram of a pixel circuit included in a display device according to the first embodiment of the present invention.

FIG. 2 is a circuit diagram of a pixel circuit included in a display device according to the first embodiment of the present invention. A pixel circuit 100 shown in FIG. 2 includes a driving TFT 110, switching TFTs 111 to 113, capacitors 121 and 122, and an organic EL element 130. All of the TFTs included in the pixel circuit 100 are of a p-channel type. The pixel circuit 100 is also described in Patent Document 1 (International Publication Pamphlet No. WO 98/48403).

The pixel circuit 100 is connected to a power supply wiring line Vp, a common cathode Vcom, a scanning line Gi, control wiring lines Wi and Ri, and a data line Sj. Of them, to the power supply wiring line Vp and the common cathode Vcom are respectively applied fixed potentials VDD and VSS (note that VDD>VSS). The common cathode Vcom is a cathode common to all organic EL elements 130 in the display device.

Terminals of the TFTs denoted as G, S, and D in FIG. 2 are referred to as a gate terminal, a source terminal, and a drain terminal, respectively. In general, in a p-channel type TFT, of the two current input/output terminals, the one with a lower applied voltage is referred to as a drain terminal, and the one with a higher applied voltage is referred to as a source terminal. In an n-channel type TFT, of the two current input/output terminals, the one with a lower applied voltage is referred to as a source terminal, and the one with a higher applied voltage is referred to as a drain terminal. However, since changing the terminal names according to the voltage magnitude relationship makes description complicated, even in the case where the voltage magnitude relationship is reversed and thus the two current input/output terminals should be called with the swapped names, the two terminals are called with the names shown in the drawing for the sake of convenience. Although in the present embodiment a p-channel type is used for all of the TFTs, an n-channel type may be used for the switching TFTs. The above description regarding the terminal names of the TFTs and the types of TFTs also applies to the second to fourth embodiments.

In the pixel circuit 100, between the power supply wiring line Vp and the common cathode Vcom there are provided the driving TFT 110, the switching TFT 113, and the organic EL element 130 in series in this order from the side of the power supply wiring line Vp. Between a gate terminal of the driving TFT 110 and the data line Sj there are provided the capacitor 121 and the switching TFT 111 in series in this order from the gate terminal side. The switching TFT 112 is provided between the gate and drain terminals of the driving TFT 110, and the capacitor 122 is provided between the gate terminal of the driving TFT 110 and the power supply wiring line Vp. A gate terminal of the switching TFT 111 is connected to the scanning line Gi, a gate terminal of the switching TFT 112 is connected to the control wiring line Wi, and a gate terminal of the switching TFT 113 is connected to the control wiring line Ri.

Note that in the pixel circuit 100 the switching TFT 111 functions as a writing switching element, the switching TFT 112 as a compensation switching element, the switching TFT 113 as an interruption switching element, the capacitor 121 as a compensation capacitor, and the capacitor 122 as a holding capacitor.

Figure 13:
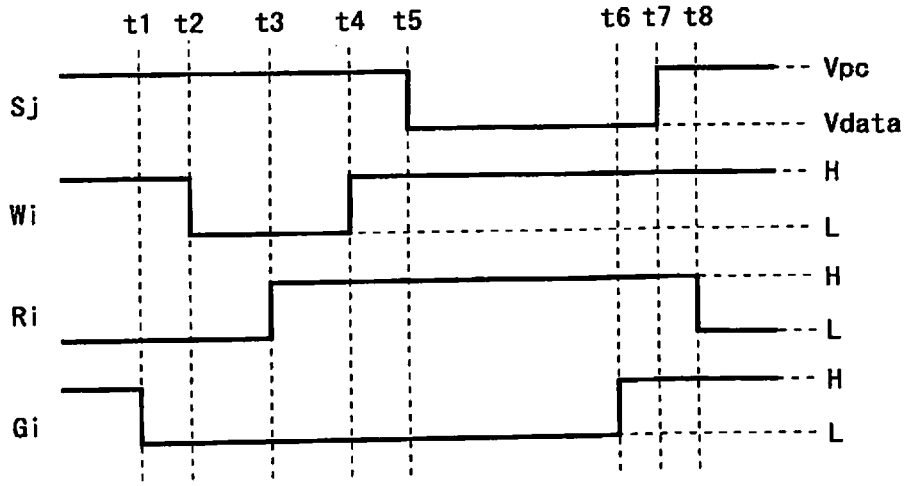
Fig. 13 Conventional Art
FIG. 13 is a timing chart showing a method of driving a pixel circuit in a conventional display device.

The display device described in Patent Document 1 compensates for variations in the threshold voltage of the driving TFT 110 by driving the pixel circuit 100 according to the timing chart shown in FIG. 13. On the other hand, the display device according to the present embodiment drives the pixel circuit 100 according to a timing chart (FIG. 3) different from the conventional one, to compensate for both variations in the threshold voltage of the driving TFT 110 and variations in the mobility of the driving TFT 110.

Figure 3:
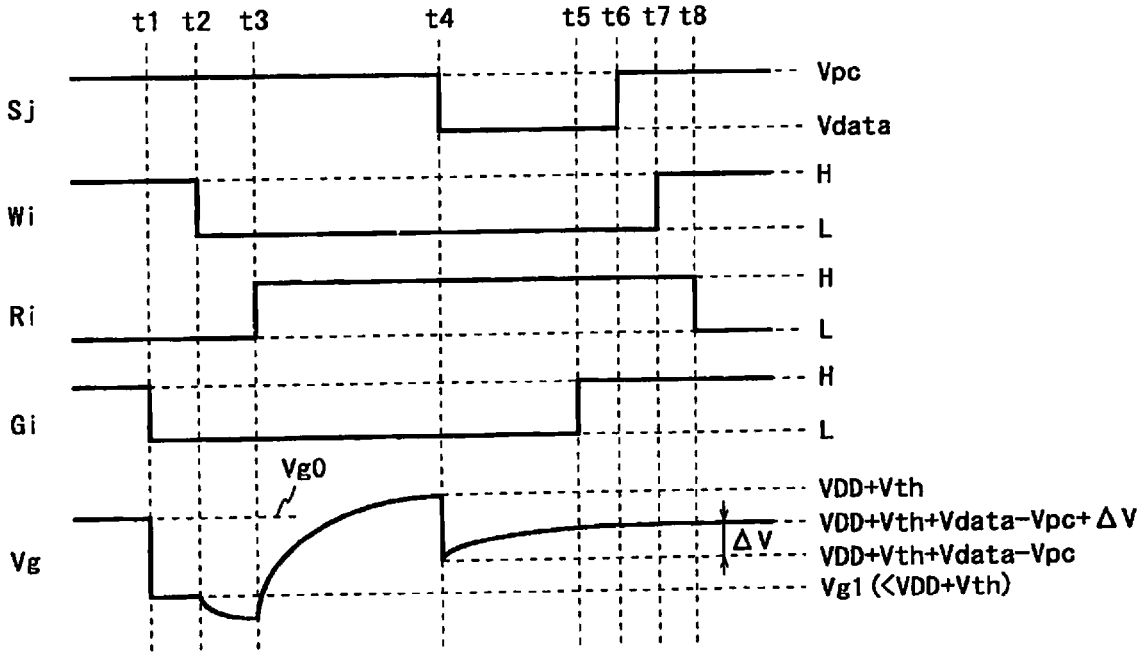
FIG. 3 is a timing chart showing a method of driving the pixel circuit in the display device according to the first embodiment of the present invention.

FIG. 3 is a timing chart showing a method of driving the pixel circuit 100 in the display device according to the present embodiment. FIG. 3 shows changes in the potentials of the data line Sj, the control wiring lines Wi and Ri, and the scanning line Gi and a change in the gate terminal potential Vg of the driving TFT 110.

As shown in FIG. 3, before time t1, the potentials of the scanning line Gi and the control wiring line Wi are controlled to a high level, the potential of the control wiring line Ri to a low level, and the potential of the data line Sj to a reference potential Vpc. When at time t1 the potential of the scanning line Gi is changed to a low level, the switching TFT 111 changes to a conducting state. At this time, the potential Vpc of the data line Sj is applied to an electrode of the capacitor 121 (an electrode on the side of the switching TFT 111).

Then, when at time t2 the potential of the control wiring line Wi is changed to a low level, the switching TFT 112 changes to a conducting state. By this, the gate and drain terminals of the driving TFT 110 are short-circuited and reach the same potential.

Then, when at time t3 the potential of the control wiring line Ri is changed to a high level, the switching TFT 113 changes to a non-conducting state. After time t3, a current flows into the gate terminal of the driving TFT 110 from the power supply wiring line Vp through the driving TFT 110 and the switching TFT 112, and thus the gate terminal potential of the driving TFT 110 rises while the driving TFT 110 is in a conducting state. The driving TFT 110 changes to a non-conducting state when the gate-source voltage thereof reaches a threshold voltage Vth (negative value) (i.e., the gate terminal potential reaches (VDD+Vth)). Therefore, the gate terminal potential of the driving TFT 110 rises to (VDD+Vth). The drive method so far is the same as the conventional one.

Then, at time t4, the potential of the data line Sj changes from the reference potential Vpc to a data potential Vdata (Vdata<Vpc except for the case of black display). The display device according to the present embodiment provides the data potential Vdata to the data line Sj with the switching TFT 112 maintaining the conducting state, which is the difference from the conventional display device that provides the data potential Vdata to the data line Sj after changing the switching TFT 112 to a non-conducting state.

When the potential of the data line Sj is changed from Vpc to Vdata, the potential at the electrode of the capacitor 121 (the electrode on the side of the switching TFT 111) also changes likewise, and the gate terminal potential of the driving TFT 110 changes by the same amount (Vdata−Vpc). As a result, the gate terminal potential Vg and gate-source voltage Vgs of the driving TFT 110 at time t4 are as shown in the following equations (2) and (3), respectively:

$$Vg=VDD+Vth+(V\text{data}-Vpc) \quad (2)$$

$$Vgs=Vth+(V\text{data}-Vpc) \quad (3).$$

Figure 4:
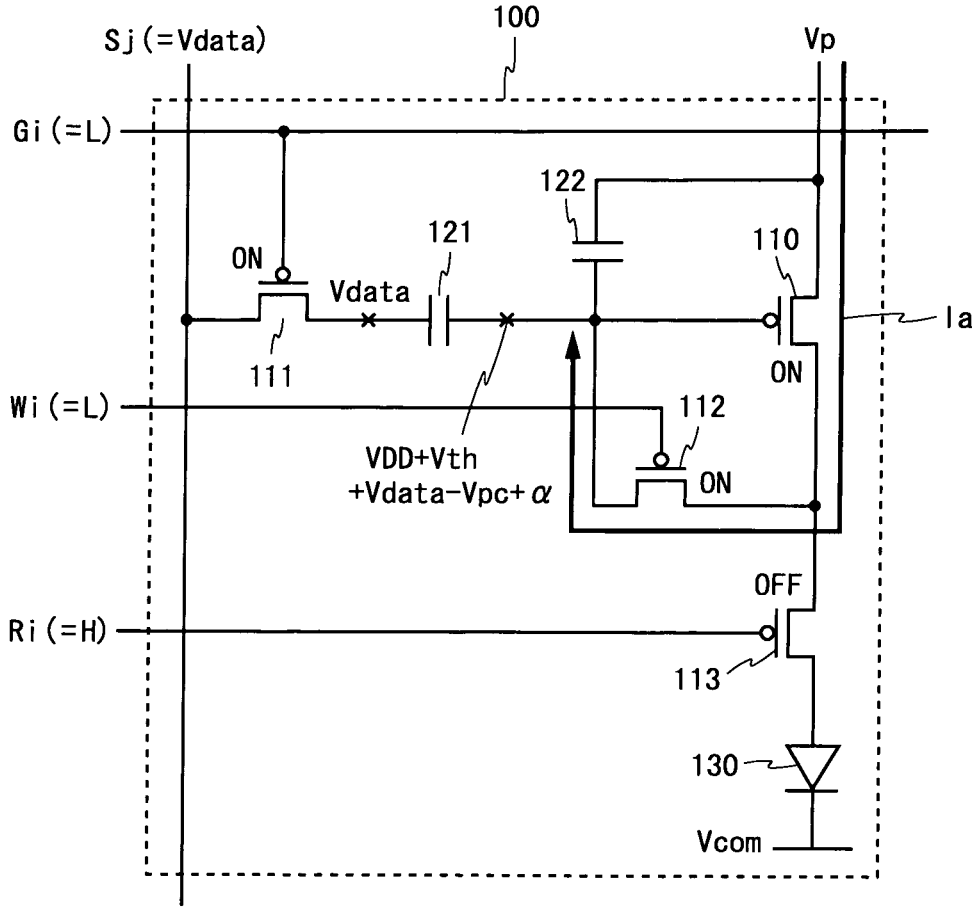
FIG. 4 is a diagram showing a state of the pixel circuit included in the display device according to the first embodiment of the present invention, immediately after the start of a mobility compensation period.

FIG. 4 is a diagram showing a state of the pixel circuit 100 immediately after time t4. After time t4, the driving TFT 110 changes to a conducting state along with the reduction in the gate-source voltage Vgs (except for the case of black display). The switching TFT 112 remains in the conducting state even after time t4. Hence, as shown in FIG. 4, immediately after time t4, a current Ia flows into the gate terminal of the driving TFT 110 from the power supply wiring line Vp through the driving TFT 110 and the switching TFT 112, and accordingly, the gate terminal potential Vg of the driving TFT 110 rises (in FIG. 4, the amount of rise is denoted as $\alpha$).

Then, when at time t5 the potential of the scanning line Gi is changed to a high level, the switching TFT 111 changes to a non-conducting state. The selection period of the pixel circuit 100 ends at this point in time. Then, at time t6, the potential of the data line Sj changes from the data potential Vdata to the reference potential Vpc. Since the switching TFT 111 is in the non-conducting state after time t5, even if the potential of the data line Sj changes at time t6, the pixel circuit 100 is not affected thereby.

Then, when at time t7 the potential of the control wiring line Wi is changed to a high level, the switching TFT 112 changes to a non-conducting state. Hence, after time t7, the current path from the power supply wiring line Vp to the gate terminal of the driving TFT 110 is interrupted, and thus the gate terminal potential of the driving TFT 110 does not rise thereafter. When the amount of change in the gate terminal potential of the driving TFT 110 during a period from time t4 to time t7 (hereinafter, referred to as a mobility compensation period) is ΔV (note that ΔV>0), the gate terminal potential Vg and gate-source voltage Vgs of the driving TFT 110 at time t7 are as shown in the following equations (4) and (5), respectively:

$$Vg=VDD+Vth+(V\text{data}-Vpc)+\Delta V \quad (4)$$

$$Vgs=Vth+(V\text{data}-Vpc)+\Delta V \quad (5)$$

In addition, at time t7, a gate-source voltage (Vth+Vdata−Vpc+ΔV) of the driving TFT 110 is held in the capacitor 122 on the side of the driving TFT 110.

Then, when at time t8 the potential of the control wiring line Ri is changed to a low level, the switching TFT 113 changes to a conducting state. After time t8, a current flows to the organic EL element 130 from the power supply wiring line Vp through the driving TFT 110 and the switching TFT 113. The amount of current flowing through the driving TFT 110 changes according to the gate-source voltage (Vth+Vdata−Vpc+ΔV) of the driving TFT 110. The organic EL element 130 emits light at a luminance according to the current flowing through the driving TFT 110.

Now, first, a case is considered ignoring ΔV. Even if the threshold voltage Vth is different, if the potential difference (Vdata−Vpc) is the same, then the amount of current flowing through the driving TFT 110 is the same. Hence, regardless of the value of the threshold voltage Vth, a current of an amount according to the data potential Vdata flows through the organic EL element 130, and thus the organic EL element 130 emits light at a luminance according to the data potential Vdata. Accordingly, the display device according to the present embodiment can compensate for variations in the threshold voltage Vth of the driving TFT 110.

Next, a case is considered including ΔV. In general, when a TFT is fabricated, the target values of the characteristics of the TFT (the threshold voltage Vth, the mobility μ, etc.) are predetermined, and then various processes are performed to bring the characteristics of the TFT to be fabricated close to the target values. However, there are two cases: the mobility μ of the fabricated TFT is higher than the target value and is lower than the target value. In the following, the case in which the mobility μ of the driving TFT 110 is equal to the target value serves as a reference case.

The current flowing into the gate terminal of the driving TFT 110 during the mobility compensation period (the current Ia shown in FIG. 4) is determined by equations (1) and (3), and increases and decreases according to the mobility μ of the driving TFT 110. When the mobility μ of the driving TFT 110 is higher than the target value, the current Ia during the mobility compensation period is larger than the reference. Due to this, the amount of change ΔV in the gate terminal potential of the driving TFT 110 during the mobility compensation period is larger than the reference, and thus the absolute value |Vgs| of the gate-source voltage of the driving TFT 110 at time t7 is smaller than the reference. Accordingly, compared to the case of compensating for only variations in the threshold voltage Vth of the driving TFT 110, a current closer to the reference flows through the organic EL element 130.

On the other hand, when the mobility μ of the driving TFT 110 is lower than the target value, the current Ia during the mobility compensation period is smaller than the reference. Due to this, the amount of change ΔV in the gate terminal potential of the driving TFT 110 during the mobility compensation period is smaller than the reference, and thus the absolute value |Vgs| of the gate-source voltage of the driving TFT 110 at time t7 is larger than the reference. Accordingly, compared to the case of compensating for only variations in the threshold voltage Vth of the driving TFT 110, a current closer to the reference flows through the organic EL element 130.

As such, in the display device according to the present embodiment, when the mobility μ of the driving TFT 110 is high, the absolute value |Vgs| of the gate-source voltage of the driving TFT 110 after the mobility compensation period is small, and thus a current closer to that of a driving TFT having the reference mobility flows through the organic EL element 130 upon light emission. When the mobility μ of the driving TFT 110 is low, the absolute value |Vgs| of the gate-source voltage of the driving TFT 110 after the mobility compensation period is large, and thus a current closer to that of a driving TFT having the reference mobility flows through the organic EL element 130 upon light emission. Hence, regardless of the value of the mobility μ, a current of an amount according to the data potential Vdata flows through the organic EL element 130, and thus the organic EL element 130 emits light at a luminance according to the data potential Vdata. Therefore, the display device according to the present embodiment can compensate for variations in the mobility of the driving TFT 110, in addition to variations in the threshold voltage of the driving TFT 110.

Note that in the display device according to the present embodiment the timing at which the potential of the data line Sj changes from the data potential Vdata to the reference potential Vpc can be any time after the potential of the scanning line Gi is changed to a high level. Namely, time t6 can be any time after time t5. Note also that the timing at which the potential of the control wiring line Wi changes to a high level is determined within a range after the potential of the data line Sj is changed from the reference potential Vpc to the data potential Vdata, and before the potential of the control wiring line Ri is changed to a low level. Namely, time t7 is determined within a range from time t4 to time t8. Time t7 is determined based on the mobility μ, variations in the threshold voltage Vth, variations in mobility μ, and the like of the driving TFT 110.

As described above, according to the display device according to the present embodiment, by driving the pixel circuit 100 shown in FIG. 2 according to the timing chart shown in FIG. 3, both variations in the threshold voltage of the driving TFT 110 and variations in the mobility of the driving TFT 110 can be compensated for, and thus the organic EL element 130 is allowed to emit light at a desired luminance.

(Second Embodiment)

Figure 5:
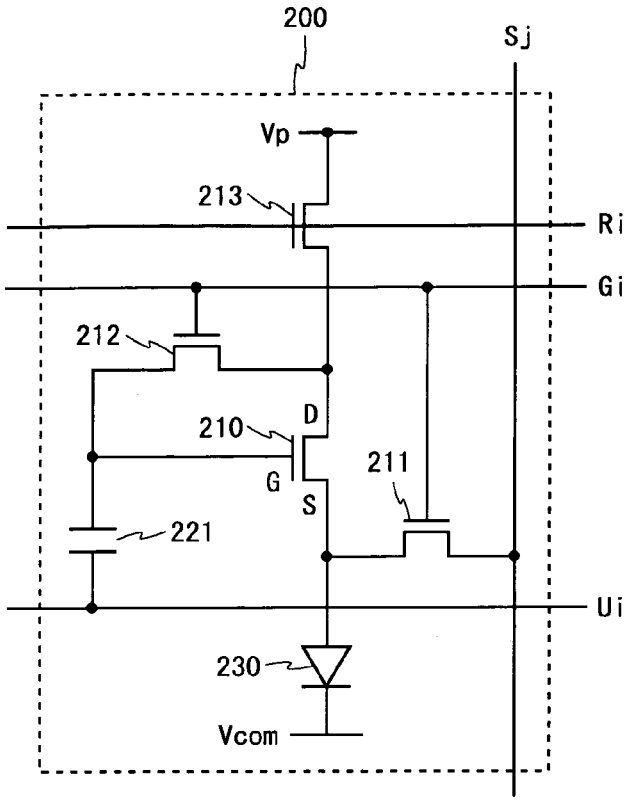
FIG. 5 is a circuit diagram of a pixel circuit included in display devices according to the second and third embodiments of the present invention.

FIG. 5 is a circuit diagram of a pixel circuit included in a display device according to the second embodiment of the present invention. A pixel circuit 200 shown in FIG. 5 includes a driving TFT 210, switching TFTs 211 to 213, a capacitor 221, and an organic EL element 230. All of the TFTs included in the pixel circuit 200 are of an n-channel type. The pixel circuit 200 is also described in another application (Japanese Patent Application No. 2008-131568) having a common applicant and a common inventor with the present application.

The pixel circuit 200 is connected to a power supply wiring line Vp, a common cathode Vcom, a scanning line Gi, control wiring lines Ri and Ui, and a data line Sj. Of them, to the power supply wiring line Vp and the common cathode Vcom are respectively applied fixed potentials VDD and VSS (note that VDD>VSS). The common cathode Vcom is a cathode common to all organic EL elements 230 in the display device.

In the pixel circuit 200, between the power supply wiring line Vp and the common cathode Vcom there are provided the switching TFT 213, the driving TFT 210, and the organic EL element 230 in series in this order from the side of the power supply wiring line Vp. The switching TFT 211 is provided between a source terminal of the driving TFT 210 and the data line Sj. The switching TFT 212 is provided between the gate and drain terminals of the driving TFT 210. The capacitor 221 is provided between the gate terminal of the driving TFT 210 and the control wiring line Ui. Both of the gate terminals of the switching TFTs 211 and 212 are connected to the scanning line Gi, and the gate terminal of the switching TFT 213 is connected to the control wiring line Ri.

Note that in the pixel circuit 200 the switching TFT 211 functions as a writing switching element, the switching TFT 212 as a compensation switching element, the switching TFT 213 as an interruption switching element, and the capacitor 221 as a compensation capacitor.

Figure 6:
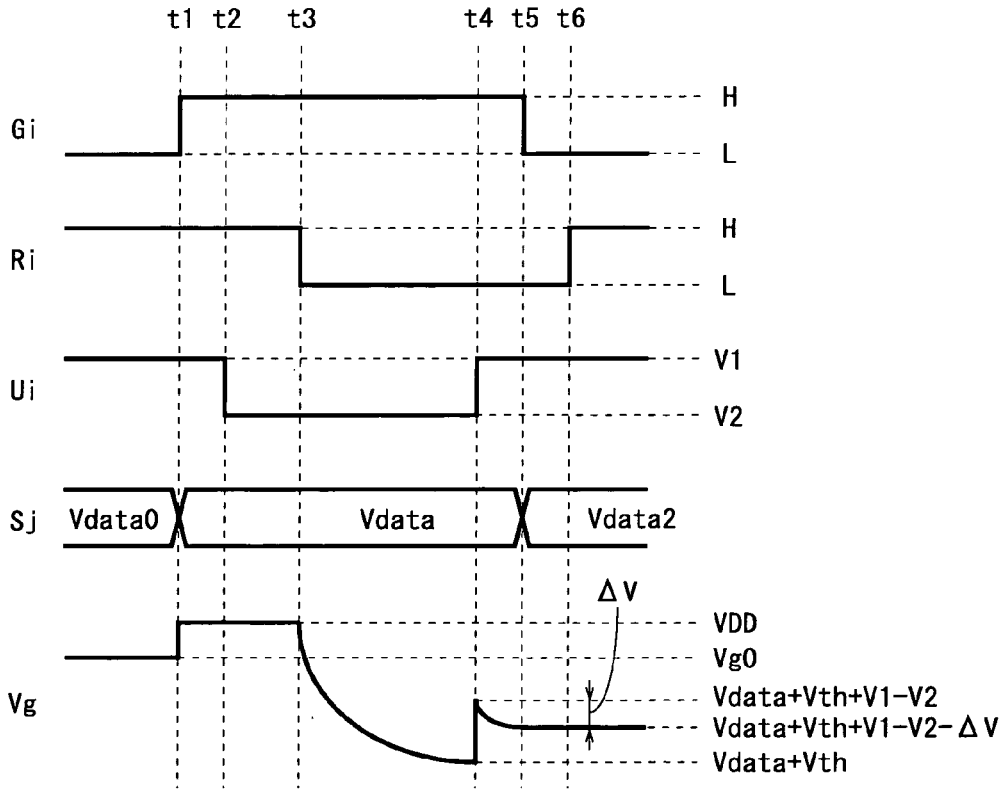
FIG. 6 is a timing chart showing a method of driving the pixel circuit in the display device according to the second embodiment of the present invention.

FIG. 6 is a timing chart showing a method of driving the pixel circuit 200 in the display device according to the present embodiment. FIG. 6 shows changes in potentials of the scanning line Gi, the control wiring lines Ri and Ui, and the data line Sj and a change in the gate terminal potential Vg of the driving TFT 210. In FIG. 6, Vg0 indicates the gate terminal potential of the driving TFT 210 obtained after writing a data potential to the pixel circuit 200 last time.

As shown in FIG. 6, before time t1, the potential of the scanning line Gi is controlled to a low level, the potential of the control wiring line Ri to a high level, and the potential of the control wiring line Ui to a relatively high potential V1. Hence, the switching TFTs 211 and 212 are in a non-conducting state and the switching TFT 213 is in a conducting state. At this time, since the driving TFT 210 is in a conducting state, a current flows to the organic EL element 230 from the power supply wiring line Vp through the switching TFT 213 and the driving TFT 210, and the organic EL element 230 emits light at a predetermined luminance.

Then at time t1, the potential of the scanning line Gi changes to a high level, and a new data potential Vdata is applied to the data line Sj. Hence, the switching TFTs 211 and 212 are placed in a conducting state, and the data potential Vdata is applied to the source terminal of the driving TFT 210 from the data line Sj through the switching TFT 211.

Note that the data potential Vdata applied at this time is determined such that the organic. EL element 230 is placed in a non-light emitting state. Specifically, when the potential of the common cathode Vcom is VSS and the light-emission threshold voltage of the organic EL element 230 is Vth_oled, the data potential Vdata is determined such that the difference between the data potential Vdata and the potential VSS is less than or equal to the light-emission threshold voltage Vth_oled. This is expressed by the following equation (6):

$$Vth_oled \geq V\text{data} - VSS \quad (6).$$

In addition, since the switching TFT 212 is in a conducting state, the gate and drain of the driving TFT 210 are short-circuited and thus a potential VDD is applied to the gate and drain terminals of the driving TFT 210 from the power supply wiring line Vp. Therefore, the gate-source voltage Vgs of the driving TFT 210 is as shown in the following equation (7):

$$Vgs = VDD - V\text{data} \quad (7).$$

Then at time t2, the potential of the control wiring line Ui changes to a relatively low potential V2. Then at time t3, the potential of the control wiring line Ri changes to a low level. Hence, the switching TFT 213 is placed in a non-conducting state, and thus a current flows to the source terminal of the driving TFT 210 from the gate terminal (and the drain terminal short-circuited thereto) of the driving TFT 210, and the gate terminal potential of the driving TFT 210 gradually drops. When the gate-source voltage of the driving TFT 210 becomes equal to a threshold voltage Vth of the driving TFT 210 (i.e., when the gate terminal potential reaches (Vdata+Vth)), the driving TFT 210 is placed in a non-conducting state and thus the gate terminal potential of the driving TFT 210 does not drop thereafter. At this point in time, the driving TFT 210 is placed in a state in which the threshold voltage Vth is applied between the gate and source thereof, regardless of the threshold voltage Vth.

A current having flown to the source terminal of the driving TFT 210 after time t3 flows through the organic EL element 230 and the switching TFT 211, according to a resistance component of the organic EL element 230 and a resistance component of the switching TFT 211 in conduction. In general, the larger the amount of current flowing through the organic EL element, the shorter the life of the organic EL element. Hence, to prevent a current from flowing through the organic EL element 230, it is desirable to use a data potential Vdata that satisfies the equation (6). When such a data potential Vdata is used, the anode and cathode of the organic EL element 230 reach the same potential or a reverse bias voltage is applied to the organic EL element 230. This prevents a current from flowing through the organic EL element 230 after time t3, enabling to extend the life of the organic EL element 230.

Then at time t4, the potential of the control wiring line Ui changes from V2 to V1. The control wiring line Ui and the gate terminal of the driving TFT 210 are connected to each other through the capacitor 221. Hence, when the potential of the control wiring line Ui is changed from V2 to V1, the gate terminal potential of the driving TFT 210 changes by the same amount (V1−V2) and results in as shown in the following equation (8):

$$Vg = V\text{data} + Vth + V1 - V2 \quad (8).$$

Figure 7:
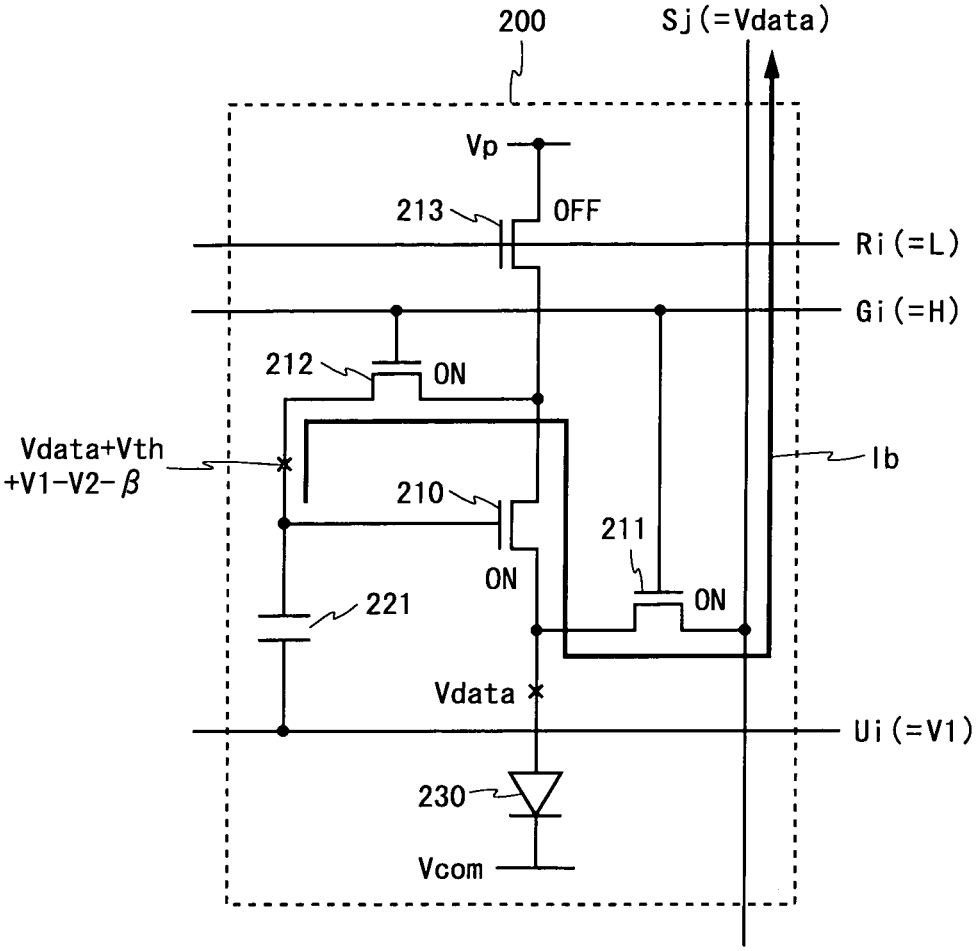
FIG. 7 is a diagram showing a state of the pixel circuit included in the display device according to the second embodiment of the present invention, immediately after the start of a mobility compensation period.

FIG. 7 is a diagram showing a state of the pixel circuit 200 immediately after time t4. After time t4, the driving TFT 210 changes to a conducting state along with the rise in the gate-source voltage Vgs (except for the case of black display). The switching TFT 212 remains in the conducting state even after time t4. Hence, as shown in FIG. 7, immediately after time t4, a current Ib flows to the data line Sj from the gate terminal (and the drain terminal short-circuited thereto) of the driving TFT 210 through the switching TFT 212, the driving TFT 210, and the switching TFT 211, and accordingly the gate terminal potential Vg of the driving TFT 210 drops (in FIG. 7, the amount of drop is denoted as β).

Then, when at time t5 the potential of the scanning line Gi is changed to a low level, the switching TFTs 211 and 212 change to a non-conducting state. When the amount of change in the gate terminal potential of the driving TFT 210 during the period from time t4 to time t5 (hereinafter, referred to as the mobility compensation period) is −ΔV (note that ΔV>0), the gate terminal potential Vg of the driving TFT 210 at time t5 is as shown in the following equation (9):

$$Vg = V\text{data} + Vth + V1 - V2 - \Delta V \quad (9).$$

In addition, at time t5, the potential difference between the electrodes of the capacitor 221 is (Vdata+Vth−V2−ΔV). After time t5, this potential difference is held in the capacitor 221. Note that time t5 is determined based on the mobility μ, variations in the threshold voltage Vth, variations in mobility μ, and the like of the driving TFT 210.

Then, when at time t6 the potential of the control wiring line Ri is changed to a high level, the switching TFT 213 changes to a conducting state, and a potential VDD is applied to the drain terminal of the driving TFT 210 from the power supply wiring line Vp. By the action of the capacitor 221, the gate terminal potential of the driving TFT 210 is maintained at (Vdata+Vth+V1−V2−ΔV) even after time t6. Hence, after time t6, a current according to a potential (Vdata+V1−V2−ΔV) obtained by subtracting the threshold voltage Vth of the driving TFT 210 from the above-described gate terminal potential flows to the organic EL element 230 from the power supply wiring line Vp through the switching TFT 213 and the organic EL element 230, and thus the organic EL element 230 emits light at a luminance according to the current.

Hence, a data potential Vdata to be applied to the data line Sj during a period during which the potential of the scanning line Gi is at a high level (from time t1 to time t5) is set to a potential obtained by subtracting an amount of amplitude (V1−V2) of the potential of the control wiring line Ui from a data potential Vdata' which is to be originally applied to allow the organic EL element 230 to emit light at a desired luminance. This is expressed as shown in the following equation (10):

$$V\text{data} = V\text{data}' - (V1 - V2) \quad (10).$$

Now first, a case is considered ignoring ΔV. Even if the threshold voltage Vth is different, if the potential (Vdata+V1−V2) is the same, then the amount of current flowing through the driving TFT 210 is the same. Hence, regardless of the value of the threshold voltage Vth, a current of an amount according to the data potential Vdata flows through the organic EL element 230, and thus the organic EL element 230 emits light at a luminance according to the data potential Vdata. As such, the display device according to the present embodiment can compensate for variations in the threshold voltage Vth of the driving TFT 210.

Next, a case is considered including ΔV. The current flowing out from the gate terminal of the driving TFT 210 during the mobility compensation period (the current Ib shown in FIG. 7) increases and decreases according to the mobility μ of the driving TFT 210, as shown in the equation (1). When the mobility μ of the driving TFT 210 is higher than the target value, the current Ib during the mobility compensation period is larger than the reference. Due to this, the amount of change ΔV in the gate terminal potential of the driving TFT 210 during the mobility compensation period is larger than the reference, and thus the absolute value |Vgs| of the gate-source voltage of the driving TFT 210 at time t5 is smaller than the reference. Accordingly, compared to the case of compensating for only variations in the threshold voltage Vth of the driving TFT 210, a current closer to the reference flows through the organic EL element 230.

On the other hand, when the mobility μ of the driving TFT 210 is lower than the target value, the current Ib during the mobility compensation period is smaller than the reference. Due to this, the amount of change ΔV in the gate terminal potential of the driving TFT 210 during the mobility compensation period is smaller than the reference, and thus the absolute value |Vgs| of the gate-source voltage of the driving TFT 210 at time t5 is larger than the reference. Accordingly, compared to the case of compensating for only variations in the threshold voltage Vth of the driving TFT 210, a current closer to the reference flows through the organic EL element 230.

As such, in the display device according to the present embodiment, too, as in the first embodiment, when the mobility of the driving TFT 210 is high, the absolute value |Vgs| of the gate-source voltage of the driving TFT 210 after the mobility compensation period is small, and thus a current closer to that of a driving TFT having the reference mobility flows through the organic EL element 230 upon light emission. On the other hand, when the mobility μ of the driving TFT 210 is low, the absolute value |Vgs| of the gate-source voltage of the driving TFT 210 after the mobility compensation period is large, and thus a current closer to that of the driving TFT having the reference mobility flows through the organic EL element 230 upon light emission. Hence, regardless of the value of the mobility μ, a current of an amount according to the data potential Vdata flows through the organic EL element 230, and thus the organic EL element 230 emits light at a luminance according to the data potential Vdata. Therefore, the display device according to the present embodiment can compensate for variations in the mobility of the driving TFT 210, in addition to variations in the threshold voltage of the driving TFT 210.

In addition, by providing a data potential that satisfies the equation (6) to the data line Sj, only writing the potential of the data line Sj to the pixel circuit 200 does not allow the organic EL element 230 to emit light. By this, only a write-target pixel circuit 200 can be controlled to a non-light emitting state with other pixel circuits 200 being allowed to emit light, enabling to increase the light-emission duty ratio.

Figure 8:
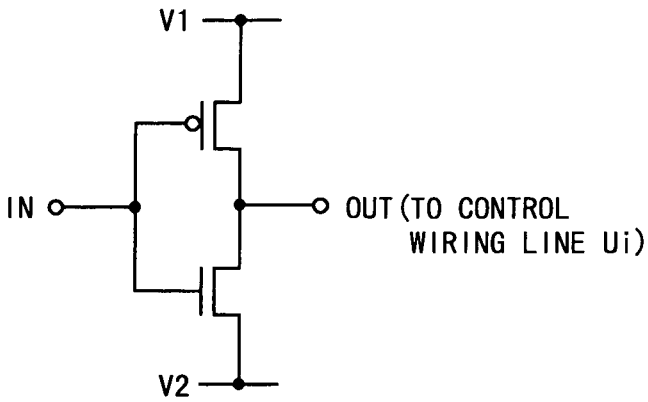
FIG. 8 is a circuit diagram of an inverter.

As shown in FIG. 6, the gate driver circuit 12 changes the potential of the control wiring line Ui in two levels (V1 and V2). Hence, an inverter circuit shown in FIG. 8 is provided at the last stage of the gate driver circuit 12, as a buffer circuit. The inverter circuit shown in FIG. 8 changes the potential of the control wiring line Ui in two levels, according to an input signal IN.

To change the potential of the control wiring line Ui in three or more levels, a more complex circuit than that in FIG. 8 is required, which increases the area of the driver circuit. Therefore, when the driver circuit is formed on a glass substrate, an increase in the size of a frame and a reduction in yield become problematic, and when the driver circuit is included in an IC, an increase in cost and a reduction in yield which result from an increase in chip area, and an increase in power consumption resulting from the complexity of the circuit become problematic. The display device according to the present embodiment includes a gate driver circuit 12 that changes the potential of the control wiring line Ui in two levels. Such a gate driver circuit can be easily formed.

Note that in the display device according to the present embodiment the timing at which the potential of the control wiring line Ui changes from V1 to V2 may be before the potential of the scanning line Gi changes to a high level. Namely, time t2 may be before time t1. According to this method, even when there are a large number of scanning lines Gi and thus the time during which the potentials of the scanning lines Gi are at a high level is short, variations in the threshold voltage of the driving TFT 210 and variations in the mobility of the driving TFT 210 can be compensated for. Note, however, that when this method is used, a forward bias voltage may be applied to the organic EL element 230 and accordingly the organic EL element 230 may unnecessarily emit light, resulting in a reduction in the contrast of a screen. Therefore, it is desirable that, as shown in FIG. 6, the potential of the control wiring line Ui changes from V1 to V2 after the potential of the scanning line Gi is changed to a high level.

In addition, although in the pixel circuit 200 the gate terminals of the switching TFTs 211 and 212 are connected to the same scanning line Gi, the switching TFTs 211 and 212 may be connected to different control wiring lines that change at substantially the same timing.

As described above, according to the display device according to the present embodiment, by driving the pixel circuit 200 shown in FIG. 5 according to the timing chart shown in FIG. 6, both variations in the threshold voltage of the driving TFT 210 and variations in the mobility of the driving TFT 210 can be compensated for, and thus the organic EL element 230 is allowed to emit light at a desired luminance.

(Third Embodiment)

A display device according to the third embodiment of the present invention includes a pixel circuit 200 shown in FIG. 5, as does a display device according to the second embodiment. The display device according to the present embodiment drives the pixel circuit 200 according to a timing chart (FIG. 9) different from that in the second embodiment.

Figure 9:
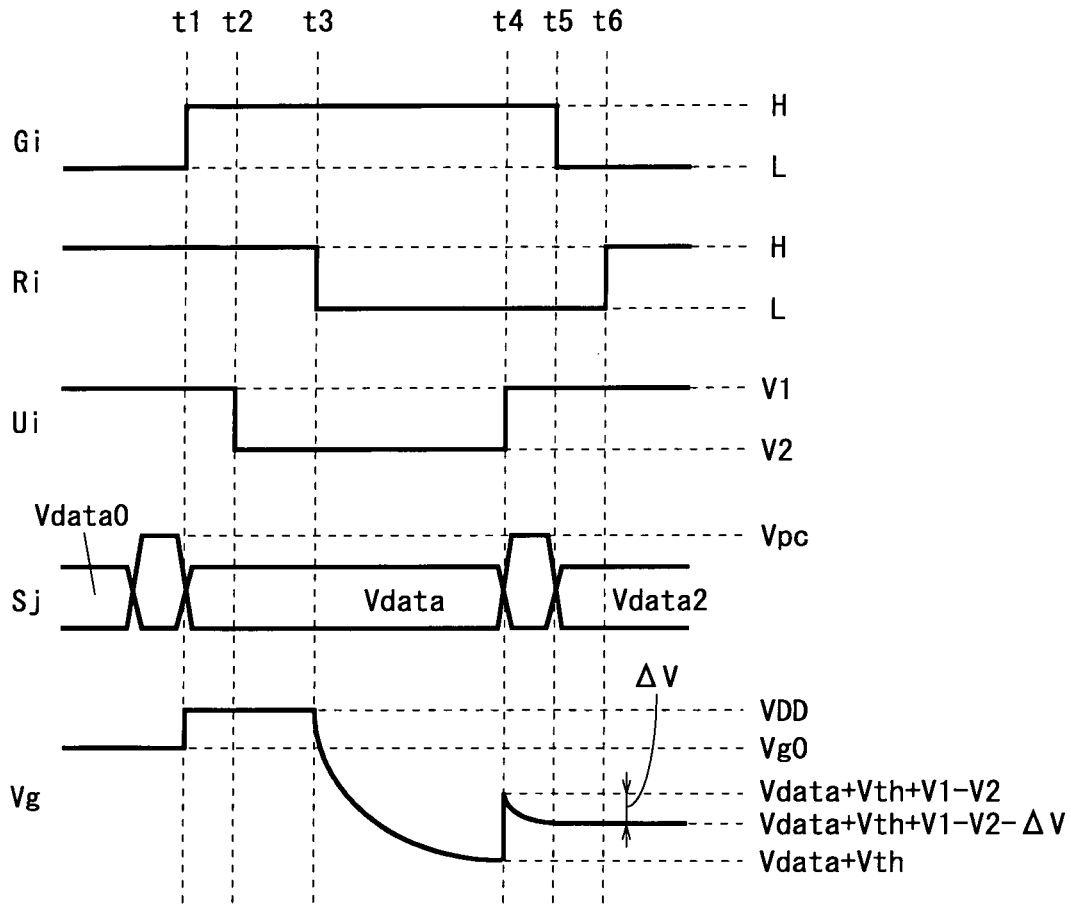
FIG. 9 is a timing chart showing a method of driving the pixel circuit in the display device according to the third embodiment of the present invention.

FIG. 9 is a timing chart showing a method of driving the pixel circuit 200 in the display device according to the present embodiment. As shown in FIG. 9, in the display device according to the present embodiment, during the period from time t4 to time t5 (mobility compensation period), the potential of a data line Sj is a reference potential Vpc which is higher than a data potential Vdata. Except for this point, the timing chart shown in FIG. 9 is the same as that shown in FIG. 6.

As such, in the display device according to the present embodiment, after the potential of a control wiring line Ui is changed from V2 to V1 (a potential at which a driving TFT 210 is placed in a conducting state), the potential of the data line Sj changes to a potential that is closer to the gate terminal potential of the driving TFT 210 than the data potential Vdata.

The reference potential Vpc is determined to be lower than a gate terminal potential of the driving TFT 210 obtained when the data potential Vdata is the lowest, in order to prevent gradation inversion. Namely, when the data potential Vdata for when the lowest gradation is displayed is Vm, the reference potential Vpc is determined to satisfy the following equation (11):

$$Vpc<Vm+Vth+V1-V2 \quad (11).$$

According to the display device according to the present embodiment, by driving the pixel circuit 200 according to the timing chart shown in FIG. 9, as in the second embodiment, a current that is not affected by variations in the threshold voltage of the driving TFT 210 nor by variations in the mobility of the driving TFT 210 is allowed to flow through an organic EL element 230, and thus both variations in the threshold voltage of the driving TFT 210 and variations in the mobility of the driving TFT 210 can be compensated for.

Figure 10:
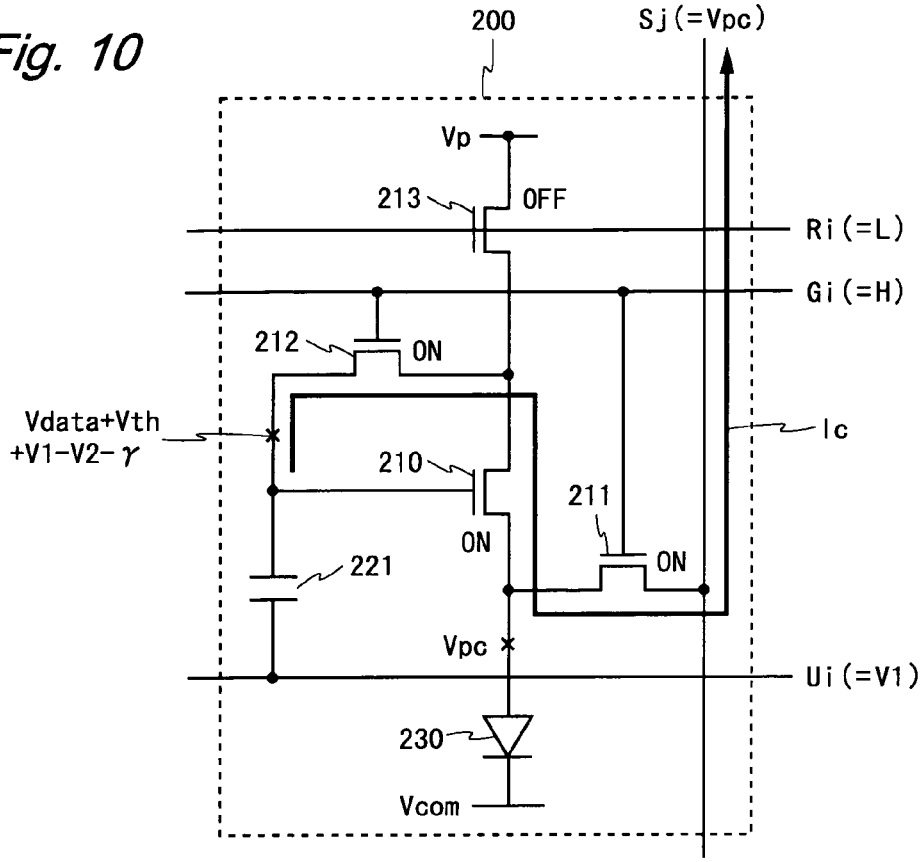
FIG. 10 is a diagram showing a state of the pixel circuit included in the display device according to the third embodiment of the present invention, immediately after the start of a mobility compensation period.

Effects specific to the display device according to the present embodiment will be described below. FIG. 10 is a diagram showing a state of the pixel circuit 200 immediately after time t4 in the display device according to the present embodiment. In the display device according to the present embodiment, too, as in the second embodiment, after time t4, a current Ic flows to the data line Sj from a gate terminal of the driving TFT 210 and thus the gate terminal potential Vg of the driving TFT 210 drops (in FIG. 10, the amount of drop is denoted as γ).

Meanwhile, some TFTs have high mobility. For example, the mobility of amorphous silicon TFTs is below 10 $cm^2/Vs$, whereas the mobilities of low-temperature polysilicon TFTs and CG silicon TFTs exceed 100 $cm^2/Vs$. Hence, when a display device according to the second embodiment is configured using TFTs with high mobility, the amount of change ΔV in the gate terminal potential of a driving TFT 210 during the mobility compensation period may become large and thus variations in the threshold voltage of the driving TFT 210 may not be able to be properly compensated for.

On the other hand, in the display device according to the present embodiment, the reference potential Vpc provided to the data line Sj after time t4 is closer to the gate terminal potential of the driving TFT 210 than the data potential Vdata. Hence, the current Ic flowing to the data line Sj from the gate terminal of the driving TFT 210 after time t4 is smaller than that in the second embodiment (Ic<Ib), and the amount of change in the gate terminal potential Vg of the driving TFT 210 is also smaller than that in the second embodiment (γ<β). As a result, the amount of change in the gate terminal potential of the driving TFT 210 during the mobility compensation period is smaller than that in the second embodiment.

Therefore, according to the display device according to the present embodiment, even if the mobility of the driving TFT 210 is high, the influence of the mobility of the driving TFT 210 exerted on the gate terminal potential of the driving TFT 210 can be reduced, and thus both variations in the threshold voltage of the driving TFT 210 and variations in the mobility of the driving TFT 210 can be compensated for.

(Fourth Embodiment)

Figure 11:
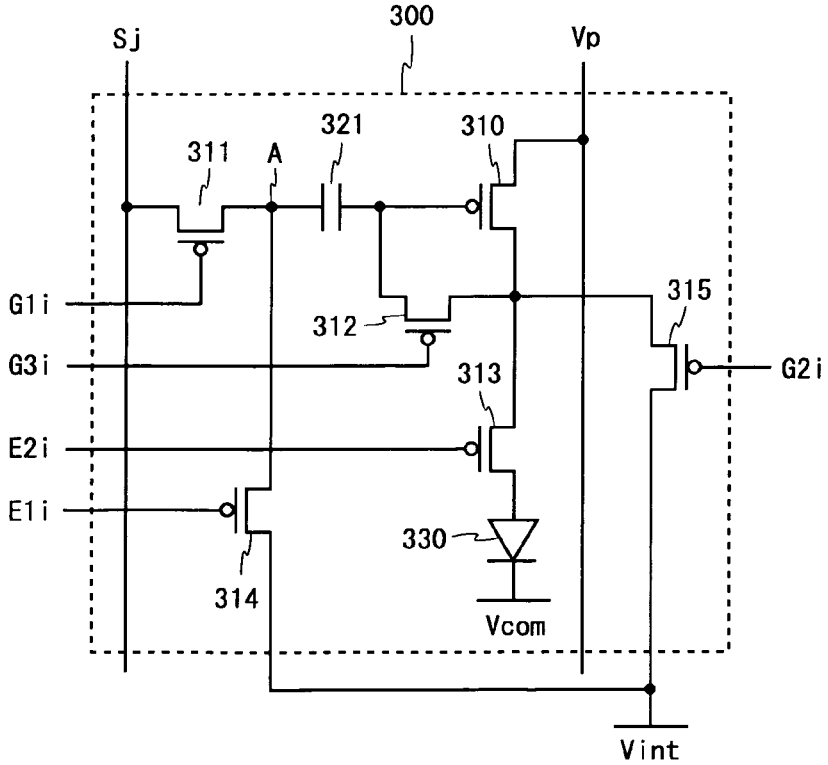
FIG. 11 is a circuit diagram of a pixel circuit included in a display device according to the fourth embodiment of the present invention.
Figure 14:
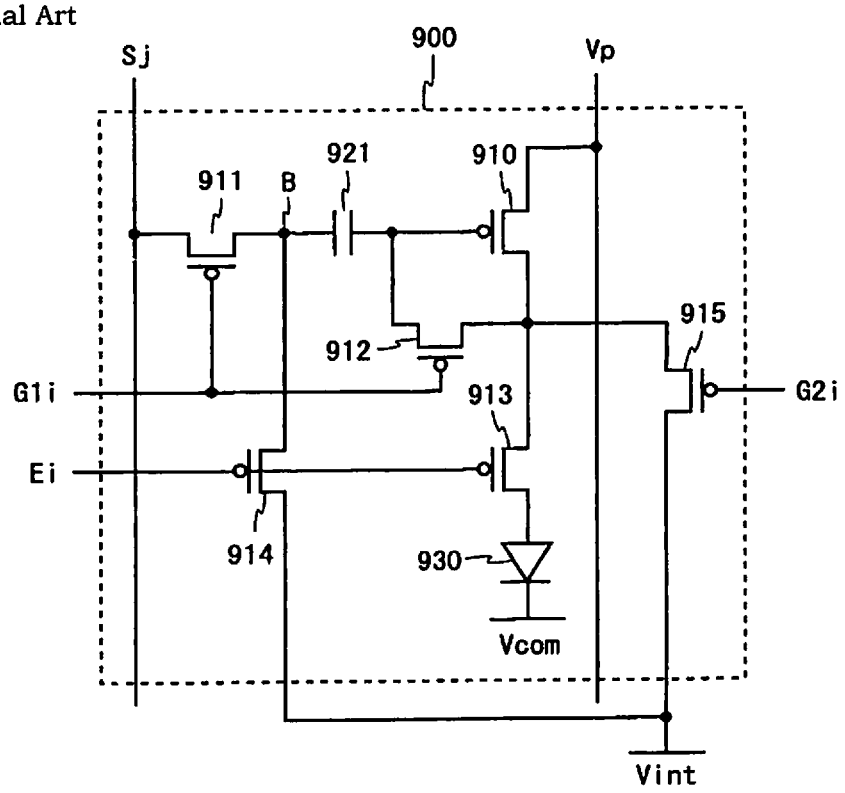
Fig. 14 Conventional Art
FIG. 14 is a circuit diagram of a pixel circuit described in a document.
Figure 15:
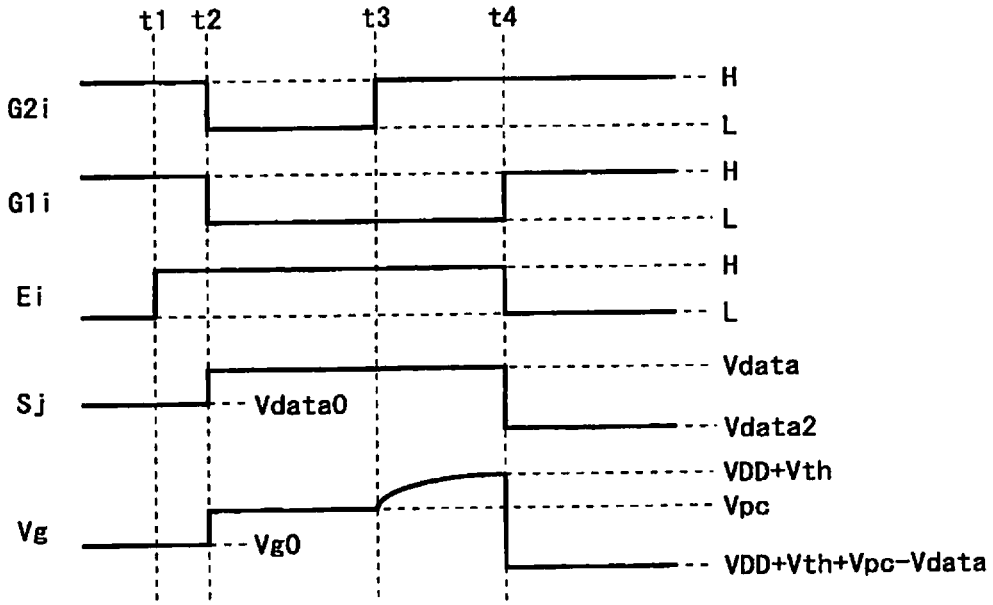
Fig. 15 Conventional Art
FIG. 15 is a timing chart showing a method of driving the pixel circuit shown in FIG. 14.

FIG. 11 is a circuit diagram of a pixel circuit included in a display device according to the fourth embodiment of the present invention. A pixel circuit 300 shown in FIG. 11 includes a driving TFT 310, switching TFTs 311 to 315, a capacitor 321, and an organic EL element 330. All of the TFTs included in the pixel circuit 300 are of a p-channel type. The pixel circuit 300 is obtained by modifying a pixel circuit (FIG. 14) described in Patent Document 2 (Japanese Laid-Open Patent Publication No. 2007-133369) such that the gate terminals of all of the switching TFTs are connected to different signal lines.

The pixel circuit 300 is connected to power supply wiring lines Vp and Vint, a common cathode Vcom, scanning lines G1*i*, G2*i*, and G3*i*, control wiring lines E1*i* and E2*i*; and a data line Sj. Of them, to the power supply wiring line Vp and the common cathode Vcom are respectively applied fixed potentials VDD and VSS (note that VDD>VSS), and to the power supply wiring line Vint is applied a fixed potential Vpc. The common cathode Vcom is a cathode common to all organic EL elements 330 in the display device.

In the pixel circuit 300, between the power supply wiring line Vp and the common cathode Vcom there are provided the driving TFT 310, the switching TFT 313, and the organic EL element 330 in series in this order from the side of the power supply wiring line Vp. Between a gate terminal of the driving TFT 310 and the data line Sj there are provided the capacitor 321 and the switching TFT 311 in series in this order from the gate terminal side. The switching TFT 312 is provided between the gate and drain terminals of the driving TFT 310. A connection point between the switching TFT 311 and the capacitor 321 is hereinafter referred to as the connection point A. The switching TFT 314 is provided between the connection point A and the power supply wiring line Vint, and the switching TFT 315 is provided between the drain terminal of the driving TFT 310 and the power supply wiring line Vint.

A gate terminal of the switching TFT 311 is connected to the scanning line G1*i*, a gate terminal of the switching TFT 312 is connected to the scanning line G3*i*, a gate terminal of the switching TFT 313 is connected to the control wiring line E2*i*, a gate terminal of the switching TFT 314 is connected to the control wiring line E1*i*, and a gate terminal of the switching TFT 315 is connected to the scanning line G2*i*. The scanning lines G1*i*, G2*i*, and G3*i* correspond to a scanning line Gi in FIG. 1.

Note that in the pixel circuit 300 the switching TFT 311 functions as a writing switching element, the switching TFT 312 as a compensation switching element, the switching TFT 313 as an interruption switching element, the switching TFT 314 as a first initialization switching element, the switching TFT 315 as a second initialization switching element, and the capacitor 321 as a compensation capacitor.

Figure 12:
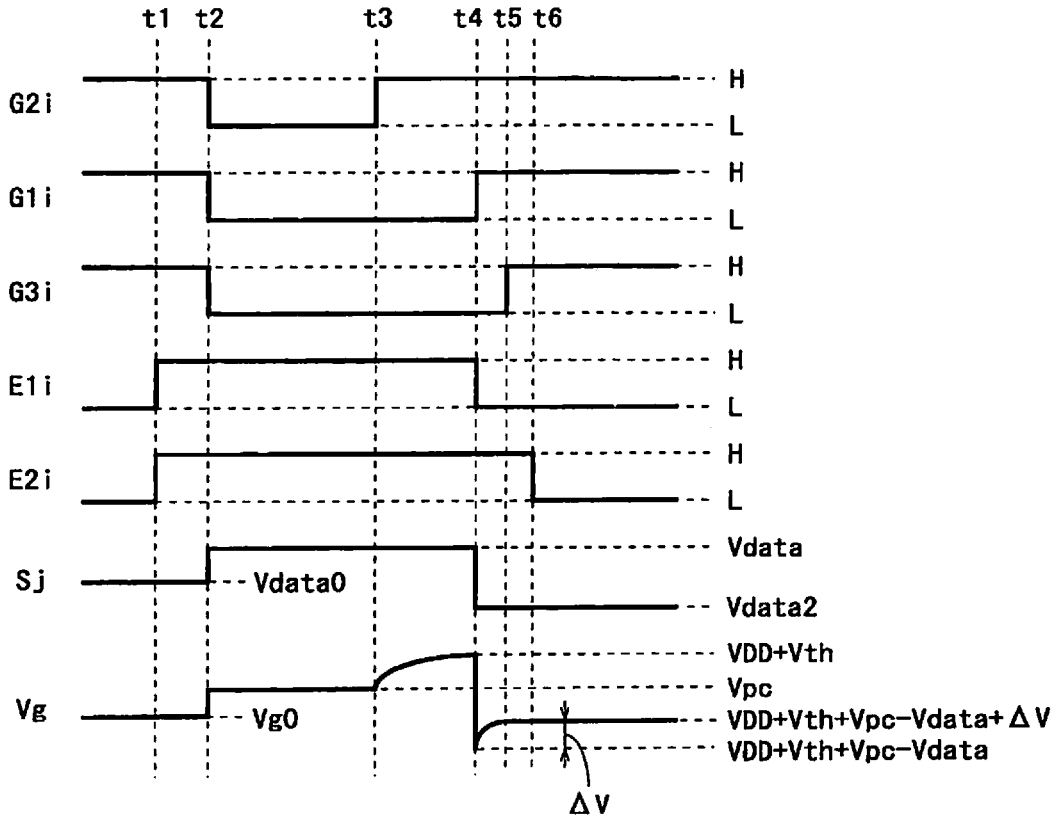
FIG. 12 is a timing chart showing a method of driving the pixel circuit in the display device according to the fourth embodiment of the present invention.

FIG. 12 is a timing chart showing a method of driving the pixel circuit 300 in the display device according to the present embodiment. FIG. 12 shows changes in the potentials of the scanning lines G1*i*, G2*i*, and G3*i*, the control wiring lines E1*i* and E2*i*, and the data line Sj, and a change in the gate terminal potential Vg of the driving TFT 310.

As shown in FIG. 12, before time t1, the potentials of the scanning lines G1*i*, G2*i*, and G3*i* are controlled to a high level, and the potentials of the control wiring lines E11 and E2*i* are controlled to a low level. Then, when at time t1 the potentials of the control wiring lines E1*i* and E2*i* are changed to a high level, the switching TFTs 313 and 314 change to a non-conducting state.

Then, when at time t2 the potentials of the scanning lines G1*i*, G2*i*, and G3*i* are changed to a low level, the switching TFTs 311, 312, and 315 change to a conducting state. By this, the gate and drain terminals of the driving TFT 310 are short-circuited and reach the same potential, and the gate terminal potential Vg of the driving TFT 310 becomes equal to the potential Vpc of the power supply wiring line Vint. In addition, a potential Vdata of the data line Sj is applied to the connection point A.

Then, when at time t3 the potential of the scanning line G2*i* is changed to a high level, the switching TFT 315 changes to a non-conducting state. At this time, a current flows into the gate terminal of the driving TFT 310 from the power supply wiring line Vp through the driving TFT 310 and the switching TFT 312, and thus the gate terminal potential Vg of the driving TFT 310 rises while the driving TFT 310 is in a conducting state. Since the driving TFT 310 changes to a non-conducting state when the gate-source voltage thereof reaches a threshold voltage Vth (negative value), the gate terminal potential Vg of the driving TFT 310 rises to (VDD+Vth).

Then, when at time t4 the potential of the scanning line G1*i* is changed to a high level and the potential of the control wiring line E1*i* is changed to a low level, the switching TFT 311 changes to a non-conducting state and the switching TFT 314 changes to a conducting state. At this time, the potential at the connection point A changes from Vdata to Vpc, and the gate terminal potential Vg of the driving TFT 310 changes by the same amount as the potential at the connection point A. As a result, the gate terminal potential Vg and gate-source voltage Vgs of the driving TFT 310 at time t4 are as shown in the following equations (12) and (13), respectively:

$$Vg=VDD+Vth+(Vpc-V\text{data}) \quad (12)$$

$$Vgs=Vth+(Vpc-V\text{data}) \quad (13).$$

In addition, at time t4, a gate-source voltage (Vth+Vpc−Vdata) of the driving TFT 310 is temporarily held in the capacitor 321 on the side of the driving TFT 310. After time t4, a current flows into the gate terminal of the driving TFT 310 from the power supply wiring line Vp through the driving TFT 310 and the switching TFT 312, and thus the gate terminal potential Vg of the driving TFT 310 rises.

Then, when at time t5 the potential of the scanning line G3*i* is changed to a high level, the switching TFT 312 changes to a non-conducting state. Hence, after time t5 the current path from the power supply wiring line Vp to the gate terminal of the driving TFT 310 is interrupted, and thus the gate terminal potential of the driving TFT 310 does not rise thereafter. When the amount of change in the gate terminal potential of the driving TFT 310 during the period from time t4 to time t5 (hereinafter, referred to as the mobility compensation period) is ΔV (note that ΔV>0), the gate terminal potential Vg and gate-source voltage Vgs of the driving TFT 310 at time t5 are as shown in the following equations (14) and (15), respectively:

$$Vg=VDD+Vth+(Vpc-V\text{data})+\Delta V \quad (14)$$

$$Vgs=Vth+(Vpc-V\text{data})+\Delta V \quad (15).$$

Then, when at time t6 the potential of the control wiring line E2*i* is changed to a low level, the switching TFT 313 changes to a conducting state. After time t6, a current flows to the organic EL element 330 from the power supply wiring line Vp through the driving TFT 310 and the switching TFT 313. The amount of current flowing through the driving TFT 310 changes according to the gate-source voltage (Vth+Vpc−Vdata+ΔV) of the driving TFT 310. The organic EL element 330 emits light at a luminance according to the current flowing through the driving TFT 310.

Now, first, a case is considered ignoring ΔV. Even if the threshold voltage Vth is different, if the potential difference (Vpc−Vdata) is the same, then the amount of current flowing through the driving TFT 310 is the same. Hence, regardless of the value of the threshold voltage Vth, a current of an amount according to the data potential Vdata flows through the organic EL element 330, and the organic EL element 330 emits light at a luminance according to the data potential Vdata. As such, the display device according to the present embodiment can compensate for variations in the threshold voltage Vth of the driving TFT 310.

Next, a case is considered including LW. The current flowing into the gate terminal of the driving TFT 310 during the mobility compensation period is determined by the equations (1) and (13), and increases and decreases according to the mobility μ of the driving TFT 310. When the mobility μ of the driving TFT 310 is higher than the target value, the current during the mobility compensation period is larger than the reference. Due to this, the amount of change ΔV in the gate terminal potential of the driving TFT 310 during the mobility compensation period is larger than the reference, and thus the absolute value |Vgs| of the gate-source voltage of the driving TFT 310 at time t5 is smaller than the reference. Accordingly, compared to the case of compensating for only variations in the threshold voltage Vth of the driving TFT 310, a current closer to the reference flows through the organic EL element 330.

On the other hand, when the mobility μ of the driving TFT 310 is lower than the target value, the current during the mobility compensation period is smaller than the reference. Due to this, the amount of change ΔV in the gate terminal potential of the driving TFT 310 during the mobility compensation period is smaller than the reference, and thus the absolute value |Vgs| of the gate-source voltage of the driving TFT 310 at time t5 is larger than the reference. Accordingly, compared to the case of compensating for only variations in the threshold voltage Vth of the driving TFT 310, a current closer to the reference flows through the organic EL element 330.

Hence, regardless of the value of the mobility μ, a current of an amount according to the data potential Vdata flows through the organic EL element 330, and thus the organic EL element 330 emits light at a luminance according to the data potential Vdata. Therefore, the display device according to the present embodiment can compensate for variations in the mobility of the driving TFT 310, in addition to variations in the threshold voltage of the driving TFT 310.

As described above, according to the display device according to the present embodiment, by driving the pixel circuit 300 shown in FIG. 11 according to the timing chart shown in FIG. 12, both variations in the threshold voltage of the driving TFT 310 and variations in the mobility of the driving TFT 310 can be compensated for, and thus the organic EL element 330 is allowed to emit light at a desired luminance.

Note that although in the above description the pixel circuit includes an organic EL element as an electro-optic element, the pixel circuit may include, as an electro-optic element, a current-driven type electro-optic element other than an organic EL element, such as a semiconductor LED (Light Emitting Diode) or a light-emitting portion of an FED.

In the above description, the pixel circuit includes, as a drive element for an electro-optic element, a TFT which is a MOS transistor (here, the MOS transistor includes a silicon gate MOS structure) formed on an insulating substrate such as a glass substrate. The configuration is not limited thereto and the pixel circuit may include, as a drive element for an electro-optic element, any voltage control type element of which output current changes according to a control voltage applied to a current control terminal thereof, and which has a control voltage (threshold voltage) at which the output current reaches zero. Thus, for a drive element for an electro-optic element, for example, a general insulated-gate type field-effect transistor including a MOS transistor formed on a semiconductor substrate, etc., can be used.

Note also that the present invention is not limited to the above-described embodiments and various changes may be made thereto. Embodiments obtained by appropriately combining technical means disclosed in the different embodiments are also included in the technical scope of the present invention.

INDUSTRIAL APPLICABILITY

Display devices of the present invention have the effect of being able to compensate for both variations in the threshold voltage of a drive element and variations in the mobility of the drive element, and thus can be used as various types of display devices including current-driven type display elements, such as organic EL displays and FEDs.

DESCRIPTION OF REFERENCE NUMERALS

10: DISPLAY DEVICE
11: DISPLAY CONTROL CIRCUIT
12: GATE DRIVER CIRCUIT
13: SOURCE DRIVER CIRCUIT
21: SHIFT REGISTER
22: REGISTER
23: LATCH CIRCUIT
24: D/A CONVERTER
100, 200, 300, and Aij: PIXEL CIRCUIT
110, 210, and 310: DRIVING TFT
111 to 113, 211 to 213, and 311 to 315: SWITCHING TFT
121, 122, 221, and 321: CAPACITOR
130, 230, and 330: ORGANIC EL ELEMENT
Gi, G1*i*, G2*i*, and G3*i*: SCANNING LINE
Ri, Ui, Wi, E1*i*, and E2*i*: CONTROL WIRING LINE
Sj: DATA LINE
Vp: POWER SUPPLY WIRING LINE
Vcom: COMMON CATHODE

The invention claimed is:

1. A current-driven type display device comprising:

a plurality of pixel circuits arranged at respective intersections of a plurality of scanning lines and a plurality of data lines; and a drive circuit that selects a write-target pixel circuit using the corresponding scanning line, and provides a data potential according to display data to the corresponding data line, wherein each of the pixel circuits includes, an electro-optic element provided between a first power supply wiring line and a second power supply wiring line;

a drive element provided in series with the electro-optic element and between the first power supply wiring line and the second power supply wiring line;

a compensation capacitor having a first electrode connected to a control terminal of the drive element;

a compensation switching element provided between the control terminal and one current input/output terminal of the drive element;

an interruption switching element provided between the one current input/output terminal of the drive element and the first power supply wiring line; and a writing switching element provided between another current input/output terminal of the drive element and the corresponding data line, a second electrode of the compensation capacitor is connected to a control wiring line to which the drive circuit provides a potential, for the write-target pixel circuit, the drive circuit is configured to provide a potential according to the display data and a threshold voltage to the control terminal of the drive element by controlling the writing switching element and the compensation switching element to a conducting state and controlling the interruption switching element to a non-conducting state while providing the data potential to the data line, and thereafter switch a potential provided to the second electrode of the compensation capacitor to another by switching a potential provided to the control wiring line to another with states of the respective switching elements including the compensation switching element being maintained, to provide a write potential according to the display data and the threshold voltage to the control terminal of the drive element, and after the drive circuit switches the potential provided to the control wiring line to another to provide the write potential to the control terminal of the drive element, the drive circuit switches the potential provided to the data line to a reference potential which is closer to the potential at the control terminal of the drive element than the data potential.

2. The display device according to claim 1, wherein for the write-target pixel circuit, the drive circuit provides, to the data line, a potential determined by the display data and an amount of change in potential provided to the control wiring line, while the writing switching element is controlled to the conducting state.

3. The display device according to claim 1, wherein for the write-target pixel circuit, the drive circuit is configured to provide, to the data line, a potential at which a voltage applied to the electro-optic element is lower than or equal to a light-emission threshold voltage, while the writing switching element is controlled to the conducting state.

4. A method of driving a current-driven type display device including a plurality of pixel circuits arranged at respective intersections of a plurality of scanning lines and a plurality of data lines, the method comprising:

when each of the pixel circuits includes an electro-optic element provided between a first power supply wiring line and a second power supply wiring line, a drive element provided in series with the electro-optic element and between the first power supply wiring line and the second power supply wiring line, a compensation capacitor having a first electrode connected to a control terminal of the drive element; a compensation switching element provided between the control terminal and one current input/output terminal of the drive element, an interruption switching element provided between the one current input/output terminal of the drive element and the first power supply wiring line, and a writing switching element provided between another current input/output terminal of the drive element and the corresponding data line, and a second electrode of the compensation capacitor is connected to a control wiring line, a selecting step of selecting a write-target pixel circuit using the corresponding scanning line;

a threshold state setting step of providing, for the write-target pixel circuit, a potential according to display data and a threshold voltage to the control terminal of the drive element by controlling the writing switching element and the compensation switching element to a conducting state and controlling the interruption switching element to a non-conducting state while a data potential according to the display data is provided to the corresponding data line; and a conducting state setting step of switching, for the write-target pixel circuit, after the threshold state setting step, a potential provided to the second electrode of the compensation capacitor to another by switching a potential provided to the control wiring line to another with states of the respective switching elements including the compensation switching element being maintained, to provide a write potential according to the display data and the threshold voltage to the control terminal of the drive element, wherein in the conducting state setting step, after the potential provided to the control wiring line is switched to another to provide the write potential to the control terminal of the drive element, the potential provided to the data line is switched to a reference potential which is closer to the potential at the control terminal of the drive element than the data potential.

5. The drive method according to claim 4, wherein for the write-target pixel circuit, a potential determined by the display data and an amount of change in potential provided to the control wiring line is provided to the data line, while the writing switching element is controlled to the conducting state.

6. The drive method according to claim 4, wherein for the write-target pixel circuit, a potential at which a voltage applied to the electro-optic element is lower than or equal to a light-emission threshold voltage is provided to the data line, while the writing switching element is controlled to the conducting state.

* * * * *